United States Patent [19]

Doundoulakis

[11] 3,985,110

[45] Oct. 12, 1976

[54] TWO-ROTOR ENGINE

[75] Inventor: George J. Doundoulakis, North Bellmore, N.Y.

[73] Assignees: William J. Casey, Roslyn; Helias Doundoulakis, Baldwin, both of N.Y. ; part interest to each

[22] Filed: Jan. 20, 1975

[21] Appl. No.: 542,250

[52] U.S. Cl. ..... 123/8.47; 123/8.05; 418/36; 418/121

[51] Int. Cl.[2] ..... F02B 53/00

[58] Field of Search ..... 123/8.05, 8.47, 64; 418/35, 33, 36

[56] References Cited

UNITED STATES PATENTS

| | | | |
|---|---|---|---|
| 987,929 | 3/1911 | Thomas | 123/8.47 X |
| 1,024,166 | 4/1912 | Weed | 123/847 |
| 1,695,704 | 12/1928 | Archer | 123/64 X |
| 2,154,095 | 4/1939 | Jones | 123/8.05 |
| 2,420,136 | 5/1947 | Hill | 123/64 |
| 2,687,609 | 8/1954 | Mallinckrodt | 123/8.47 X |
| 3,292,602 | 12/1966 | Stewart | 123/8.47 |

FOREIGN PATENTS OR APPLICATIONS

| | | | |
|---|---|---|---|
| 545,002 | 7/1922 | France | 123/8.47 |

*Primary Examiner*—Carlton R. Croyle
*Assistant Examiner*—Michael Koczo, Jr.
*Attorney, Agent, or Firm*—Constantine Michalos

[57] ABSTRACT

A multi-stroke engine for converting energy into torque is described including two rotors and a housing along surfaces of revolution of genus 1 about same axis. In the preferred configuration a cavity of revolution is used, generated by the revolution of a rectangle about the axis, two sides of the rectangle being parallel to the axis; one half of the cylindrical surface generated by the side nearest the axis is allocated to each rotor, while the surface generated by the other three sides of the rectangle is allocated to the housing. $n$ substantially similar diaphragms having azimouthal thickness substantially equal to 90/n° extend from each rotor at azimouthal angles $360/n$ across the cavity of revolution and are interleaved with the diaphragms of the other rotor so that the diaphragms divide the cavity of revolution in $2n$ chambers the volume of half of the chambers increasing while the volume of the others is equally decreasing as the rotors are pressured to rotate with respect to each other. The chambers are assigned to execute sequential strokes of predetermined cycles; cycles involving 2, 4, 8 and 10 strokes are described with the complex cycles also used for converting heat in unburned hydrocarbons, and heat trapped on the walls of the chambers and in the hot exhaust gases to useful torque. The average rotational motion of the rotors is combined through a differential gear assembly into rotation of a center shaft. Means are provided for limiting the reverse rotation of the rotors, the rotors execute average rotational displacements equal to $180/n°$ per power stroke. A plate rotating with speed equal to the center shaft serves to program the particular cycle, to sequence strokes and to advance the stroke pattern. Means are also described for sealing the volumes between chambers, for lubricating surfaces in relative motion, for cooling and for starting the engine. Relatively lightweight, small volume, and efficient power plants are described when the engine is combined with auxiliary components normally used with such power plants as hydrostatic, geothermal gaseous pressure, steam, gasoline, and Diesel power plants.

13 Claims, 29 Drawing Figures

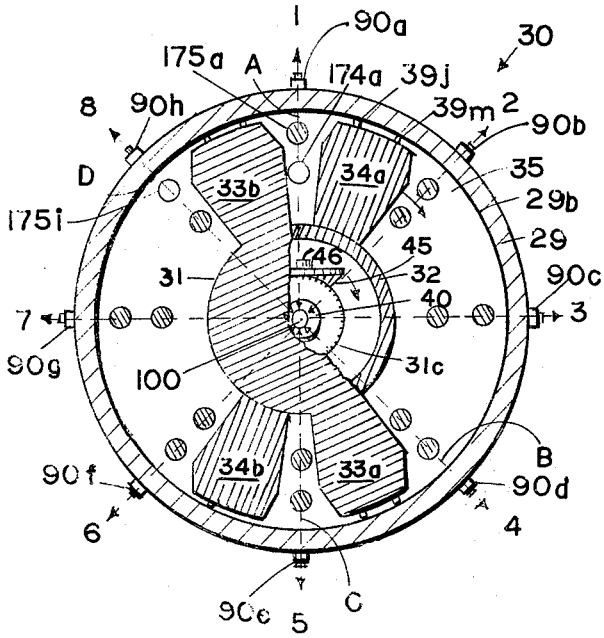
FIG. 2a
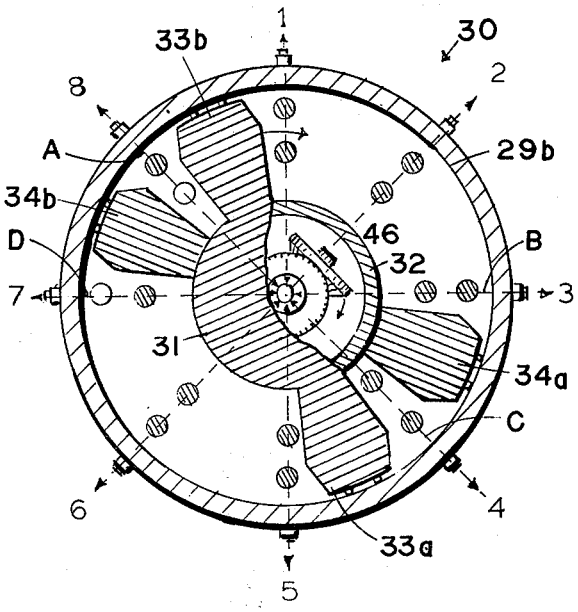
FIG. 2b
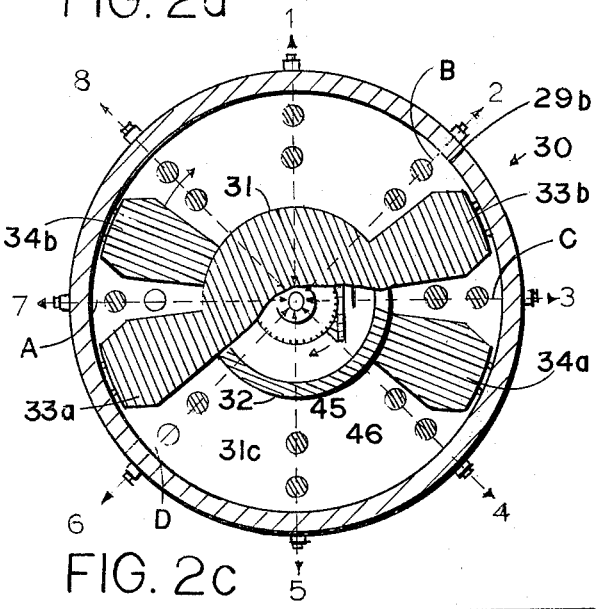
FIG. 2c
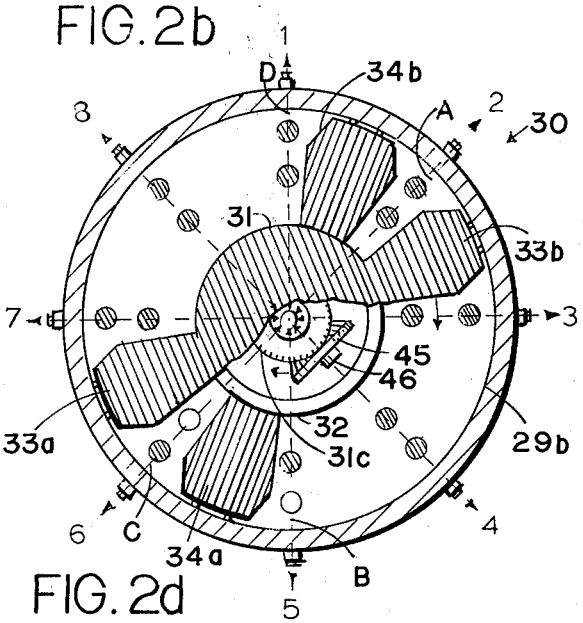
FIG. 2d
| PLANE | TIME STROKE INTERVALS | | | | | | | |
|---|---|---|---|---|---|---|---|---|
| 0-1 | A | | | B | C | | | D |
| 0-2 | | | B | C | | | D | A |
| 0-3 | | B | C | | | D | A | |
| 0-4 | B | C | | | D | A | | |
| 0-5 | C | | | D | A | | | B |
| 0-6 | | | D | A | | | B | C |
| 0-7 | | D | A | | | B | C | |
| 0-8 | D | A | | | B | C | | |
FIG. 3
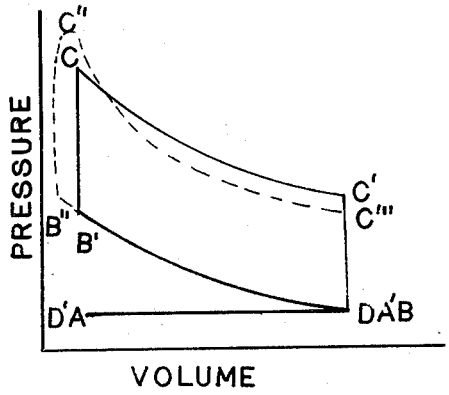
FIG. 4

| PLANE | TIME STROKES | | | | | | | | | | | | | | | |
|---|---|---|---|---|---|---|---|---|---|---|---|---|---|---|---|---|
| 0-1 | A | | | B | C | | | D | E | | | F | G | | | H |
| 0-2 | | | B | C | | | D | E | | | F | G | | | H | A |
| 0-3 | | B | C | | | D | E | | | F | G | | | H | A | |
| 0-4 | B | C | | | D | E | | | F | G | | | H | A | | |
| 0-5 | C | | | D | E | | | F | G | | | H | A | | | B |
| 0-6 | | | D | E | | | F | G | | | H | A | | | B | C |
| 0-7 | | D | E | | | F | G | | | H | A | | | B | C | |
| 0-8 | D | E | | | F | G | | | H | A | | | B | C | | |
| 0-9 | E | | | F | G | | | H | A | | | B | C | | | D |
| 0-10 | | | F | G | | | H | A | | | B | C | | | D | E |
| 0-11 | | F | G | | | H | A | | | B | C | | | D | E | |
| 0-12 | F | G | | | H | A | | | B | C | | | D | E | | |
| 0-13 | G | | | H | A | | | B | C | | | D | E | | | F |
| 0-14 | | | H | A | | | B | C | | | D | E | | | F | G |
| 0-15 | | H | A | | | B | C | | | D | E | | | F | G | |
| 0-16 | H | A | | | B | C | | | D | E | | | F | G | | |

FIG. 16

| PLANE | TIME STROKES | | | | | | | | | | | | | | | | | | | |
|---|---|---|---|---|---|---|---|---|---|---|---|---|---|---|---|---|---|---|---|---|
| 0-1 | A | | | B | C | | | D | E | | | F | G | | | H | I | | | J |
| 0-2 | | | B | C | | | D | E | | | F | G | | | H | I | | | J | A |
| 0-3 | | B | C | | | D | E | | | F | G | | | H | I | | | J | A | |
| 0-4 | B | C | | | D | E | | | F | G | | | H | I | | | J | A | | |
| 0-5 | C | | | D | E | | | F | G | | | H | I | | | J | A | | | B |
| 0-6 | | | D | E | | | F | G | | | H | I | | | J | A | | | B | C |
| 0-7 | | D | E | | | F | G | | | H | I | | | J | A | | | B | C | |
| 0-8 | D | E | | | F | G | | | H | I | | | J | A | | | B | C | | |
| 0-9 | E | | | F | G | | | H | I | | | J | A | | | B | C | | | D |
| 0-10 | | | F | G | | | H | I | | | J | A | | | B | C | | | D | E |
| 0-11 | | F | G | | | H | I | | | J | A | | | B | C | | | D | E | |
| 0-12 | F | G | | | H | I | | | J | A | | | B | C | | | D | E | | |
| 0-13 | G | | | H | I | | | J | A | | | B | C | | | D | E | | | F |
| 0-14 | | | H | I | | | J | A | | | B | C | | | D | E | | | F | G |
| 0-15 | | H | I | | | J | A | | | B | C | | | D | E | | | F | G | |
| 0-16 | H | I | | | J | A | | | B | C | | | D | E | | | F | G | | |
| 0-17 | I | | | J | A | | | B | C | | | D | E | | | F | G | | | H |
| 0-18 | | | J | A | | | B | C | | | D | E | | | F | G | | | H | I |
| 0-19 | | J | A | | | B | C | | | D | E | | | F | G | | | H | I | |
| 0-20 | J | A | | | B | C | | | D | E | | | F | G | | | H | I | | |

FIG. 17

TWO-ROTOR ENGINE

1. Field of the Invention

The invention relates to engines for converting energy into torque. More specifically it relates to the field of multi-stroke rotary engines generating torque with respect to a housing. In particular the invention involves two rotors providing torque with respect to a housing.

2. Description of the Prior Art

There are known in the prior art multi-stroke engines which are converting energy into torque, involving two configurations: the piston engine and the rotary combustion engine, also known as the Wankel engine. The piston configuration involves cylindrical pistons at one or both bases of cylindrical cavities, the volume of which varies as the pistons move along the axes of the cylinder in simple harmonic motion under the influence of expanding hot gases. The linear motion of the pistons is subsequently changed into rotational motion through an arrangement of connecting piston rods and a crankshaft. The piston configuration also involves an elaborate system of valves. Piston engines are operated as two-stroke or four-stroke engines. A two stroke engine processes an amount of energy in two steps: that is, energy enters into an expansion chamber during the first step and the degraded remains of the energy are expelled from the chamber during the second step. Expansion of the chamber is carried out through work done by conversion of the energy, in the form of gaseous pressure, into work on the pistons of the chamber. One example of a two-stroke engine is the steam engine. In the steam engine, the gaseous pressure is generated outside the expansion chamber and, for this reason, the steam is referred to as an "External Combustion Engine". In the case of the steam engines, additional thermodynamic steps, such as generating, preheating, and condensing the steam, are preformed outside the main configuration of the engine. But these steps, while part of the overall steam cycle, are to be considered, as far as this specification goes, as auxiliary processes performed by components auxiliary to the main engine. The engines which generate the gaseous pressure inside the expansion chamber by the burning of chemical fuels are known as "Internal Combustion Engines". Two types of Internal Combustion Engines are well known: the "Otto Cycle Engines" and the "Diesel Cycle Engines". The main difference between the Otto Engine and the Diesel Engine is in the method of feeding and of igniting the fuel in the combustion chamber. In the Diesel engine, the fuel is fed, often in the form of a spray, under high pressure into air which has been compressed in the combustion chamber to sufficiently high pressure for its temperature to rise above the temperature of ignition of the fuel, thereby igniting the fuel. While in the Otto engine, air, pre-carburated with fuel, is being fed and compressed into the chamber, only to medium pressure, and ignition is accomplished by an electric spark. Two-stroke Diesel engines have been known to work successfully.

Most of the internal combustion engines operate in a four-stroke cycle, including strokes for Intake, Compression, Power, and Exhaust. Four-stroke Diesel engines are well known; and so are the four-stroke Otto Cycle Engines, commonly referred to as "Gasoline Engines." In the case of the internal combustion engine, operations such as carburation of the air fuel mixture, battery storage, and charging of such batteries to provide spark ignition in the gasoline engines; special pumps for the compression and spraying or injection means for introducing the fuel into engines operated in the Diesel cycle; and air fans, oil and water pumps for the lubrication and cooling of both types of engines will be considered in this specification as auxiliary processes and components and not a part of the main engine. The entire system, including the main engine and auxilary components and processes will be referred to in this specification as a "Power Plant."

In the field of Gasoline Engines, we distinguish two types of engines: the Piston Engine and the Rotary or Wankel Engine. For the same output torque, the Wankel Engine is known to be smaller in size, lighter, having about half the number of moving parts, having less vibration and being cheaper to manufacture than the piston engine. It needs no valves or piston rods. The Wankel engine, however, does present sealing problems between chambers and lubrication problems. The main reason for these problems is the geometry of the Wankel rotor moving eccentrically with respect to a double lobe epitrochoidal surface. There are theoretically only three lines of contact between the rotor and the epitrochoidal surface. Sealing elements have been used along these lines; but the sealing elements are not touching the epitrochoidal surface normally. That is, the angle between the plane of the sealing elements and the tangent plane at the point of contact varies widely from the optimum angle of ninety degrees. Chambers of different pressure are therefore separated by thin lines of contact. In the piston engine the piston rings remain normal to the cylindrical surface so that the entire outer surface of the piston ring is continuously in contact with the inner cylinder surface. It is this characteristic of cylindrical piston rings which enables the piston configuration to withstand the extreme pressures involved in the Diesel engine. It would be difficult for the weak sealing element used in the Wankel engine to perform in the case where the Wankel configuration were to be used in a Diesel cycle. This is because manufacturing tolerences and thermal distortions expected at the elevated pressures and temperatures required in a Diesel cycle would cause mismatching between elements and surfaces contributing the pressure losses.

The present invention provides the aforesaid advantages of a rotary engine, such as the Wankel engine, over the commonly used piston engines; but in addition it overcomes the weak points of the Wankel engine. The present invention thus includes two coaxial rotors which rotate concentrically with respect to the axis of the engine. The internal surface of the housing is coaxial to both rotors. The plane of each sealing element always remains normal to both surfaces which it separates and seals. Therefore, a surface comprising the entire thickness of the sealing element, rather than a line, is used for sealing. The accurate sealing provided by the present invention minimizes pressure losses and therefore contributes to higher efficiency. Because of the concentric geometry, the height of the sealing elements between two surfaces can be as short as the prevailing manufacturing tolerance of the surfaces involved with respect to the axis. Therefore, sealing elements can withstand high pressures. In the present invention, because of the concentric geometry, two or more sealing elements may run parallel to each other, as in the case of piston rings, to better separate and seal two adjacent chambers. Lubricating oil can run between such parallel sealing elements to lubricate the sliding contact between sealing element and surface for reducing the wear and the friction losses for further increase in efficiency.

Today, more than ever before, the automotive industry is faced with restrictions as to the amount of pollutants exhausted by the automobile engine. Also because of the current energy shortage, the industry is pressured to provide a relatively light and compact engine for automobile with high fuel efficiency. The Wankel Engine embodied one step towards light-weight and compactness, but it has not been enough. The Wankel did not provide improvement in thermal efficiency. The thermal efficiency of most of the engines presently used is low, with the gasoline engines displaying an efficiency around 25 percent, the Diesel engines, 35 percent, and the steam engines about 20 percent. In the gasoline engines, about one third of the fuel energy is wasted in the cooling system, one third is used up in useful output torque, auxiliaries and friction, and the last third is expelled as hot and partially burned gases in the exhaust.

Better than the conventional four-stroke cycle employed in most of the internal combustion engines would be an engine capable of being operated in more than four cycles. The additional cycles would be used for three purposes: (1) a more complete burning of the hydrocarbons, (2) the extraction and utilization towards useful torque of some of the heat now being wasted in the hot exhaust gases as heat and incompletely burned hydrocarbons and (3) for extraction and utilization of heat trapped in the walls of the combustion chambers and wasted in the water or air cooling system. The Wankel engine is limited to a four-stroke cycle with only three chambers. It is desireable that the engine have a greater number of chambers for smooth operation and be operated in more than four strokes for greater efficiency. Further, it is important, for smooth operation, increased power, and higher volumetric efficiency, that the engine provide a high equivalent number of cylinders, assuming four equivalent cylinders per power cycle per revolution of the output shaft. For each revolution of the rotor in the Wankel Engine, there are three power strokes and three revolutions of the output shaft. In the four cylinder piston engine, there is a half power stroke per revolution of the crankshaft. It may therefore be argued that the Wankel Engine is equivalent to an eight cylinder piston engine, as the Wankel Engine provides twice as many strokes per revolution of the output shaft as the four cylinder piston engine.

The present invention can provide an even greater number of equivalent piston cylinders for smoothness and efficiency and a greater number of power strokes per revolution of the output shaft, for greater volume efficiency, than either the piston engine or the Wankel engine. One of the examples described in this application shows how the present invention can be used to provide a gasoline engine equivalent of between two and six power strokes per revolution of the output shaft. This is equivalent to a piston engine of between 16 and 48 cylinders. Usually, there are four strokes used per cycle in internal combustion engines. In this example there are ten strokes per cycle. The extra strokes provided by the invention contribute to these ends: (1) increasing the amount of useful torque for same fuel, (2) reducing the amount of semi-burned hydrocarbons in the exhaust, (3) and reducing size of the cooling system. Useful torque is obtained by utilizing heat obtained from the afterburning of the hydrocarbons, from the gases, and from the walls of the combustion chambers. The afterburning of the hydrocarbons elminates them from the exhaust, thus reducing pollutants. And since much of the heat in the engine is being converted into useful torque, the size of the cooling system can be reduced, as less cooling is needed. Reduction of the cooling system is reflected in reduction of the overall weight of the car, and ultimately in greater efficiency.

The present invention provides a new configuration in engine design next to the piston configuration and the Wankel configuration. Besides the aforementioned advantages and features provided over and beyond the prior art, the present invention yields a flexible design easily adapted to various applications. It may be used as a steam engine or an internal combustion engine, in an Otto cycle or a Diesel cycle engine with savings in weight, size, and cost. This is so because the present invention provides the geometrical advantages of a rotary engine with the ruggedness of a piston engine.

Years ago, big electrical power plants found in ships, electric factories, and locomotives were mainly steam engines using coal as fuel. Today, most of these power plants have been replaced by Diesel engines. Up to now, the considerations of greater efficiency and reduction of pollutants has not been of great priority. But with increasing interest in ecology and energy conservation, concern over these considerations will extend to the entire field of internal combustion engines. Therefore, the present invention has utility in the overall struggle for a better environment and for conservation of energy.

The Wankel engine is known to have less wear than the piston engines. The reason for this is that as the rotor is rotatably supported by an efficient bearing around an accentric, there is no radial force between the internal wall of the expansion chambers and the sealing elements. In the piston engines, radial forces are generated between the piston rings and the cylindrical surface of the expansion chambers as the angle between the piston rods and the axis of the cylinder chambers deviates from the zero value. The invention generates no radial forces between the sealing elements and the walls of the expansion chambers, and rotors and housing are kept at a fixed distance by means of efficient bearings. Besides, the fact that the invention provides a surface common to the sealing elements and the revolving surfaces will contribute to less wear in the walls and sealing elements of the invention than in those of either the piston engine or the Wankel engine.

In both, the piston engine and the Wankel engine there is considerable unbalance. In the case of the Wankel engine, the unbalance involves only harmonic forces and is cancelled with the addition of a counterweight to counterbalance the radial forces created by the rotation of the accentric cylinder. The piston engine, however, has reciprocating imbalance with a higher-order of harmonics that cannot be canceled with a simple counterweight. In the V-8 engine, which is a well known piston engine configuration, some cancelation of the unbalanced forces is accomplished in certain multicylinder designs where the unbalanced forces of one cylinder are equal and opposite to those of another. It is this balancing which causes the V-8 engine to provide a smoother operation than a "Four- Cylinder In-Line Engine" which is another well-known piston engine design. Because of its concentric geometry, the present invention is inherently balanced and does not need counter weights or intercylinder balancing.

The piston engine requires an elaborate system of intake and exhaust valves, adding to the weight, cost, wear, and reliability of the engine. The Wankel engine requires no such valves because its geometry inherently provides positions where such intake and exhaust ports may be installed. But the opening and closing of these natural ports does present problems in sealing. The purpose of sealing is to prevent communication of gases between two adjacent chambers via the port. The problem is inherent in the Wankel geometry where, as it has been explained, the sealing between two adjacent chambers is provided by a line, whereas a port involves a surface. Pressure looses, therefore, are expected to occur as the sealing element traverses the intake and exhaust ports.

In the present invention the opening and closing of intake and exhaust ports is accomplished preferably by a single circular port regulating plate whose rotational speed is exactly equal and opposite to the rotation of the output shaft and its axis is the same as the main axis of the engine. Motion to this plate may therefore be provided by means of gears interposed between a geared edge provided by the output shaft and a geared edge provided by the port regulating plate. While the port regulating plate and associated gearing constitutes components needed in the present invention and not needed in the Wankel engine, the port regulating plate provides the means of accurately controlling the timing of gas intake and exhaust and further it provides, in a simple way, the preprogramming of the engine operation in a multi-stroke operation. Besides, accurate timing in opening and closing ports used effectively in the piston engine to compensate for the viscosity of the moving gases, for the purpose of optimization of the cycle, is a difficult problem for the Wankel configuration, but can be efficiently accomplished by means of the port regulating plate in the present invention.

SUMMARY

In summary this invention comprises a novel rotary, coaxial, concentric configuration for converting energy into torque, including a housing having internally a first surface of revolution about an axis, and a pair of rotors each having a surface of revolution with respect to same axis so that the three surfaces of revolution form a closed cavity of revolution about the axis. Each rotor has securely attached to it a number of cavity diaphragms equidistantly arranged along its surface of revolution, and normally extending from this surface and rotatably dividing the cavity of revolution into same number of equal subcavities as the number of diaphragms on either rotor. The diaphragms from one rotor are alternated across the cavity with the diaphragms extending across the cavity from the other rotor so that each aforesaid subcavity is further divided in two variable volume chambers, the volume of one being increased as the volume of the other is being equally decreased when the two rotors, and therefore the diaphragms attached to them, rotate with respect to each other. The chambers are aranged to perform suction of air and fuel, compression, and combustion in a predetermined stroke sequence in accordance with a particular thermodynamic cycle. The invention further includes means for intaking into the chambers at predetermined rotational positions, either hot gases such as steam or fuel which can be burned into producing hot gases for providing pressure causing a first rotor to rotate in a forward direction, the second rotor to rotate in the reverse direction. Ratchet and pawl means are provided for limiting the rotation of the second rotor with respect to the housing, the expansion of the chamber thus resulting in a predetermined forward rotational stroke of the first rotor. The invention further provides means for cycling the chambers to undergo through a sequence of strokes ABCD . . . representing predetermined operations such as intake, compression, power, exhaust, etc., of a predetermined thermodynamic cycle providing forward torque alternately to the first and then to the second rotor.

Gear means transfer the resulting torque from either rotor to an output shaft which keeps rotating in the forward rotation an amount equal to the average rotation of the rotors as the rotors are alternately being rotated in the forward direction.

If the aforementioned sequence of strokes in a cycle is to be represented by the letters and sequence of the alphabet, ABCD . . . the aforementioned chambers in the invention, starting from a chamber in stroke A are arranged in ABCD . . . sequence when considered in the rotational direction which has been assigned to represent the forward direction. Further, in accordance with the invention, the sequence ABCD . . . rotates in the reverse direction an angle equal to the average rotation of the two rotors. This characteristic of the invention makes possible the opening and closing of intake and exhaust ports and gaseous exchange between specific chambers when requred, cyclically, by means of a single port control plate whose rotational motion is geared to be same and opposite to that of the output shaft.

The invention further provides engaging and rotor controlling means for the purpose of providing torque from a starter motor to the rotors for starting the engine and for controlling the forward motion of the rotors to a predetermined maximum forward rotational excursion in case of misfiring during a power stroke. The engaging and controlling means preferably include for each rotor a slotted disc, securely attached and rotating with the output shaft; at least one roller whose axis is extending from each rotor parallel to the main axis and through a radially slanted slot on the aforesaid slotted disc, the roller being continuously and radially adjustable in accordance with the radial coordinate presented by the aforesaid radially slanted slot; the engaging and rotor controlling means further including a circumferentially disposed plate providing protrusions for intermittently limiting the excursion of the roller and therefore its rotor during starting of the engine or during misfiring of a power stroke.

Two features of the invention, first, being capable of providing a relatively large number of chambers within a single cavity or revolution and, second, that of providing a port control plate which is a flexible means of controlling complex sequence of strokes also provide the facility of operating the invention in complex thermodynamic cycles. Two examples of such complex cycles are described in the specification. One involves eight strokes, four of the strokes, ABCD, being utilized as in the Otto cycle, for A, suction of fuel, B, compression, C, power, and D, exhaust, the other four strokes used for converting heat entrapped in the walls of the chambers during the power cycle, into gaseous pressure and finally useful torque involving E, suction of cold air, F, compression, G, power, and H, exhaust.

The second example of a complex cycle, described in the specification, involves ten cycles, the first three strokes, ABC, being same as in the Otto cycle for A, suction of fuel, B, compression, and C, power; the remaining seven strokes, D, E, F, G, H, I, J involve strokes for extracting heat by after-burning of unburned hydrocarbons, from the heat entrapped on the wall of the cavity, and the hot gases which, in the Otto cycle, normally are being exhausted. Stroke D is used for compressing and mixing the hot gases subsequent to the initial combustion in the C stroke with a chamber full of cool air in the chamber under stroke H. As the temperature of the mixture of the hot and partially burned gases are being mixed and compressed during the cycles D and H, the temperature in both cavities rises with new supply of oxygen for total burning of CO and HC towards generation of heat. Additional heat is also being transferred to the fresh air from the hot burned gases and from the hot walls of the cavity; the strokes E and I follow as power strokes providing useful torque with the strokes F and J used for the exhaust of the burned gases.

By adding additional strokes such as the group E, F, G, and H in the previous example sufficient heat may be extracted from the walls of the cavity so that the cooling system can be eliminated.

The configuration provided by the invention is applied to the fields of both external and internal combustion engines. As an external combustion engine, the invention is operated as a two-stroke engine, either with a single diaphragm on each rotor providing 180° rotation per stroke or with a plurality of diaphragms being acted upon simultaneously by the gaseous pressure in a relatively small size, light engine, for increased output torque and overall efficiency. The invention then can provide a steam engine power plant when used in combination with standard heating, super-heating and condenser means which, in this application, are considered auxiliary to the engine provided by the invention.

As an internal combustion engine, the invention provides a rugged construction when used as a Diesel and a lighter construction when used as a gasoline engine. A Diesel power plant may be formed including the invention in combination with a standard Diesel high pressure pumping system for solid injection or air injection of the fuel into the combustion chambers; lubricating oil and water pumping means for lubricating and cooling the engine; and further including a compressed air system or an electric starter motor for starting the engine.

A gasoline engine power plant may be formed including the invention in combination with standard carburator, means for preparing a mixture of air carburated with the hydrocarbons in the gasoline fuel, spark means including standard direct current generator, storage battery, and ignition system means for providing ignition sparks to the carborated mixture in the combustion chamber and lubricating oil and water pumping means for lubricating and cooling the engine.

The main object of the invention therefore consists in providing a novel coaxial and concentric configuration for a rotary engine for converting energy into torque wherein an engine of a relatively small size, light weight, improved manufacturability, lower cost, increased reliability, lower wear, improved thermal efficiency, serviceability and safety, is achieved.

A further main object of the invention consists in providing a novel configuration for a steam engine for converting energy stored in hot vapor to useful torque, this configuration resulting in a steam engine of relatively small size, light weight, improved manufacturability, lower cost, increased reliability, lower wear, improved thermal efficiency, serviceability and safety in comparison with conventional piston steam engines.

Still a further main object of the invention consists in providing a novel configuration for a gasoline engine for converting chemical fuel into useful torque, this configuration resulting in a gasoline engine of relatively small size, light weight, improved manufacturability, lower cost, increased serviceability and safety in comparison with conventional gasoline engines of both piston and Wankel engine configurations.

Another main object of the invention consists in providing a novel configuration for a Diesel engine for converting chemical fuel into useful torque, this configuration resulting in a Diesel engine of relatively small size, light weight, improved manufacturability lower cost, increased serviceability and safety in comparison with conventional Diesel engines.

It is another object of this invention to provide a coaxial concentric and self balanced configuration for an engine for transforming energy into torque for smooth operation.

It is another object of this invention to provide a rotary engine for converting energy into torque including efficient sealing means for efficient operation.

It is another object of this invention to provide an efficient rotary engine for converting energy into torque including efficient oil lubricating means wherein the oil is forced to flow between and lubricate sealing elements which extend from diaphragms attached to two rotors and are in sliding contact with surfaces of revolution inside the rotary engine.

It is another object of the invention to provide a rotary engine for converting energy into torque, including a rotating plate for accurately regulating the opening and closing of the intake and exhaust ports for the purpose of lower cost, simplicity, reduction in wear, and cycle versatility whereby greater overall efficiency can be realized.

It is another object of the invention to provide an internal combustion rotary engine for converting chemical fuels into torque, capable of being arranged to work in an eight cycle operation, the extra cycles being used for extracting heat energy from the walls of the combustion chambers and converting it to useful torque instead of such heat as is common in conventional internal combustion engines being wasted in the cooling system whereby a higher thermal efficiency can result.

It is another object of the invention to provide an internal combustion rotary engine for converting chemical fuels into torque, such engine being capable of being arranged to work in an extra-cycle operation wherein a number of the extra cycles are used for reignition and afterburning of the fuel gases for more complete burning of initially not burned or partially burned hydrocarbons and for conversion of the heat generated by such afterburning to useful torque; a number of the extra cycles are used for extracting heat from the burned gases normally expelled and being wasted into the atmosphere and for converting such heat to useful torque; and a number of extra cycles being used for extracting heat from the walls of the combustion chambers and converting it to torque instead of such heat being wasted into the cooling system; whereby a number of power cycles are provided for increasing the thermal efficiency of the engine for reducing the amount of carbon monoxide normally polluting the atmosphere by conventional internal combustion engines, and for reducing or eliminating the need for a cooling system altogether.

It is another object of the present invention to provide a small, light weight, powerful, efficient engine for use in automobiles whereby a lighter, smaller, safer, and less expensive car can result with the space and weight now devoted to a large and heavy engine become available as passenger and luggage space.

The further objects of the invention will be more clearly understood when referring to the following specification.

BRIEF DESCRIPTION OF THE DRAWINGS

The invention is illustrated diagrammatically in the accompanying drawings by way of examples. The diagrams illustrate only the principles of the invention and how these principles are embodied in various fields of application. It is however to be understood that the purely diagrammatic showing does not offer a survey of other possible constructions and a departure from the constructional features diagrammatically illustrated does not necessarily imply a departure from the principles of the invention. It is therefore to be understood that the invention is capable of numerous modifications and variations apparent to those skilled in the art without departing from the spirit and scope of the invention.

In the accompanying drawings, forming part hereof, similar reference characters designate corresponding parts.

FIGS. 2*a*, 2*b*, 2*c*, and 2*d* are horizontal cross-sectional views of a portion of the engine taken along the line 2—2 of FIG. 1, illustrating successive positions of characteristic parts of the invention as the engine advanced through four strokes of an Otto cycle; with portion of a rotor broken away for the purpose of revealing a portion of a second rotor and the successive positions of a differential gear assembly.

FIG. 3 is a table relating 8 planes, which represent chambers, and four characters ABCD which represent particular strokes as time advances in an Otto cycle performed by the invention as illustrated in FIGS. 2*a*, 2*b*, 2*c*, and 2*d*.

FIG. 4 is a PRESSURE vs VOLUME cycle diagram illustrating a comparison of the pressure-volume relationship in the present invention when applied as a four stroke gasoline engine, and the classical Otto cycle pressure volume relationship often found in the literature about engines.

FIG. 16 is a table like that shown in FIG. 3 but here referring to the eight-stroke cycle illustrated in connection with FIGS. 10, 11, and 14.

FIG. 17 is a table like that shown in FIG. 3 but here referring to the 10-stroke cycle illustrated in connection with FIGS. 12, 13 and 15.

DETAILED DESCRIPTION OF THE PREFERRED EMBODIMENTS

Figure 1:
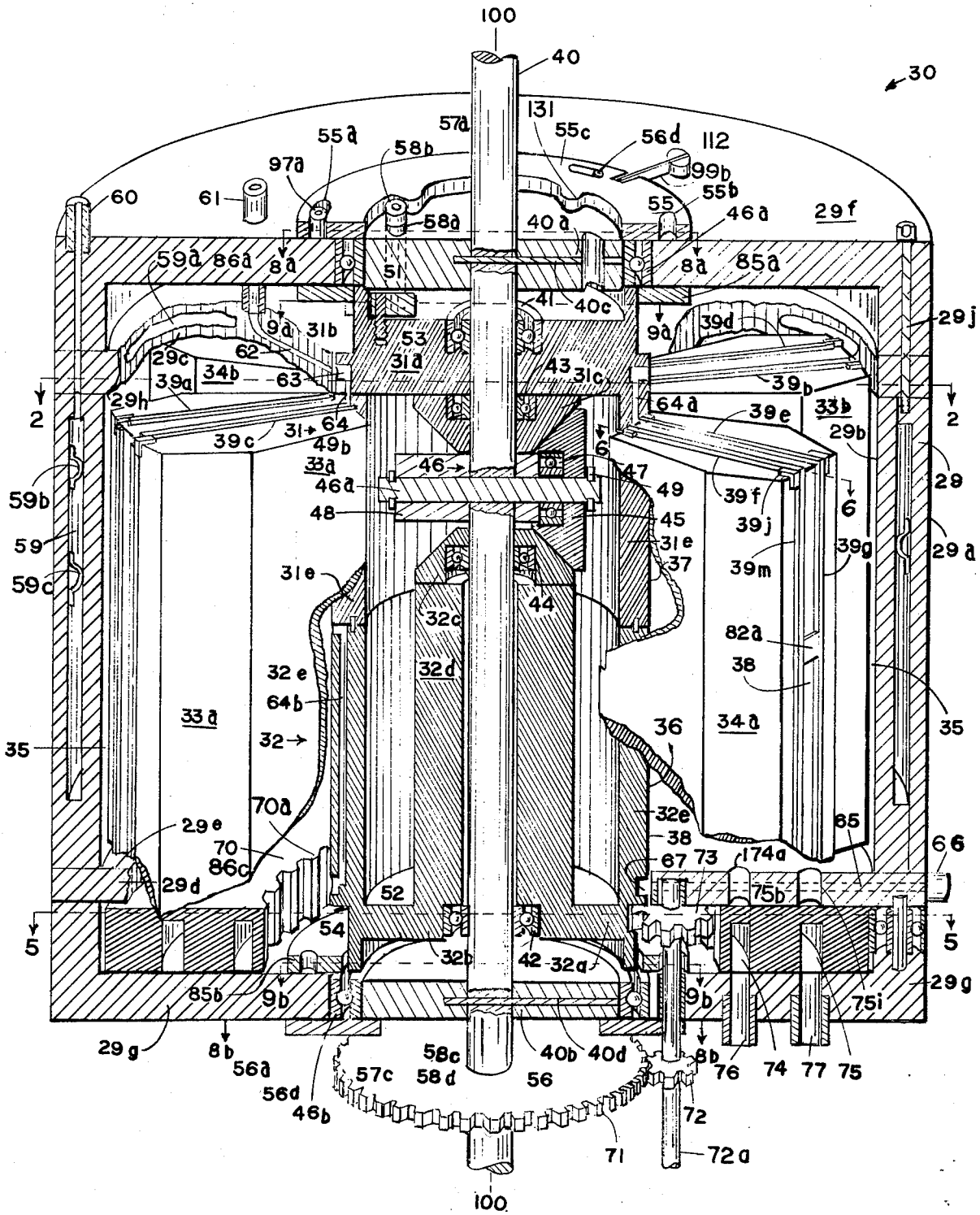
FIG. 1 is an external, partially schematic, perspective view of an engine constructed in accordance with the features of the present invention, with portions of the external housing broken away and the center portion of the engine cross-sectionalized for ease of illustrating the invention.

The engine covered by the invention is based on principles which will be best understood by referring to FIGS. 1 to 9. Referring now to FIG. 1, there is shown an engine 30 for illustrating the preferred characteristics incorporated herein in accordance with the principles of the invention.

HOUSING AND CENTER SHAFT

A main housing 29 is shown to have a cylindrical shape about a vertical axis 100—100, comprising a cylindrical side 29*a* providing internally a cylindrical surface of revolution 29*b*, and bounded by circular bases 29*c* and 29*d* which provide internally surfaces of revolution 29*h* and 29*e*, respectively. Externally to the bases 29*c* and 29*d* are shown cylindrical housing extensions 29*f* and 29*g*, respectively, securely fastened onto the main housing 29 by fastening means such as screws 29*j*. A center shaft 40 is rotatably supported on the housing extensions 29*f* and 29*g* through two cylinders 40*a* and 40*b*, respectively, securely fastened to the center shaft 40 by such fastening means as pins 40*c* and 40*d*, respectively. The assembly of center shaft 40 and cylinders 40*a* and 40*b* is rotatably supported on the housing extentions 29*f* and 29*g* through bearings 46*a* and 46*b*, respectively.

ROTORS AND DIFFERENTIAL GEAR ASSEMBLY

On the center shaft 40 there are rotatably supported two rotors, a first rotor 31, and a second rotor 32, each by a pair of bearings, a first pair consisting of bearings 41 and 43 and a second pair of bearings consisting of bearings 42 and 44 supporting the rotors 31 and 32, respectively. The first rotor 31 includes a hollow cylindrical member 31*e* coaxial with the center shaft 40, a substantially cylindrical member 31*a* forming a top base to the hollow cylindrical member 31*e*, and a bevel gear 31*c*, each coaxially disposed about the center shaft 40. The second rotor 32 includes a hollow cylindrical member 32*e*, a substantially cylindrical member 32*a* forming a bottom base to the hollow cylindrical member 32*e*, a level gear 32*c*, and cylinder 32*d* for interconnecting the gear 32*c* and the cylindrical member 32a. The bevel gears 31*c* and 32*c* together with an intermediate bevel gear 45 make up a differential gear assembly 46. The gear 45 is rotatably supported on a shaft 46*a* which is normally fastened through the center shaft 40. A block 48 is rotatably supported around the center shaft 40 and by the shaft 46*a* for serving as a counterweight to cancel the centrifugal forces introduced by the revolution of the intermediate gear 45, about the axis 100. The differential gear assembly 46 has the purpose of imparting onto the center shaft 40 an exact average of the rotational motion of the two rotors, 31 and 32; that is, half of the sum of the rotational motion of the two rotors 31 and 32.

CAVITY OF REVOLUTION OF GENUS 1

The hollow cylinders 31*e* and 32*e* of rotors 31 and 32, respectively, each provide a surface of revolution 37 and 36, respectively, so that the totality of surface provided by the surfaces 29*b*, 29*h*, 29*e*, 37 and 36 forms a closed cavity of revolution 35, bounded by the housing and the hollow cylinders of the two rotors. topologically this type of closed surface is defined as being of genus 1, and is generated by the revolution of a closed curve about an axis lying outside the closed curve. Examples of closed curves are circles, ellipses, rectangles, trapezoids and an infinite number of combinations of straight lines and curved lines forming closed curves. The choice as to what closed curve to use as the generating curve about the axis 100 to generate the cavity of revolution of genus 1 provided by the invention, depends on the state and methods provided by the current technology of manufacturing. The choice also depends on technical considerations such as the way a particular cavity of revolution will expand with rising temperature and the strength associated with the particular design. The cavity of revolution of genus 1 serves in the engine provided by the invention a similar function as the cylindrical surface of the combustion chambers serves in a piston engine. In the preferred embodiment of the invention shown in FIG. 1, the generating curve is a rectangle formed by the intersection of a vertical plane passing through the axis 100 and the surfaces 29*b*, 29*h*, 29*e*, 37 and 36. The cavity 35 is therefore generated by the revolution of the aforesaid rectangle about the axis 100. It is to be noted that if a circle were to be chosen as the generating curve the cavity 35 would have been a torus. While a torus does present a certain geometrical simplicity and certain technical advantages over the rectangle, to be further explained later in this discussion, the rectangle has been chosen to illustrate the invention because the rectangle provides more degrees of freedom than the circle.

CHAMBERS AND DIAPHRAGMS

It is a common characteristic of multistroke engines to provide chambers whose volume varies either under the work done by the expansion of hot gases inside the chambers onto movable walls of the chamber or through the driving influence of forces external to the particular chambers onto the movable walls of the chambers. In the piston engines the movable walls of the chambers are the pistons. In the Wankel engine both the housing and the rotor constitute movable walls. In the present invention the movable walls are provided in terms of cavity diaphragms 33*a* and 33*b* extending from the first rotor 31, and diaphragms 34*a* and 34*b* extending from the second rotor 32 across the cavity 35. While in FIG. 1 each rotor is shown to provide two cavity diaphragms it will be shown later in this description that other species of the engine provided by the invention may have a single diaphragm per rotor and may have other plurality of diaphragms such as four and five diaphragms per rotor. In the case of two diaphragms per rotor, shown in FIG. 1, the diaphragms of each rotor are extending across the cavity 35 substantially symmetrical with respect to the axis 100, so that the assembly of each rotor and its associated diaphragms provides a rotationally self-balanced configuration. The cavity diaphragms 33*a* and 33*b* could be fabricated as one piece with the rotor 31 or could be fabricated separately and fastened through welding or screws onto the surface of revolution 37 of the hollow cylindrical member 31*e*, which is part of the rotor 31. Same consideration goes with the diaphragms 34*a* and 34*b* in connection with the rotor 32. Each diaphragm is bounded and is in sliding contact with the surfaces 29*b*, 29*e* and 29*h* internally provided by the housing 29. The side of the diaphragm towards the axis 100 is bounded by the cylindrical surfaces 37 and 36 provided by the rotors 31 and 32, respectively. Each of the cylindrical surfaces 37 and 36 covers substantially half the side of the cavity 35 which lies towards the axis 100. Each diaphragm therefore is in direct contact with the rotor to which it belongs, along the inside side, which lies towards the axis 100, and along half the height of the cavity 35. Along the remaining half the height the inside surface of each diaphragm is in sliding contact with the cylindrical surface of the other rotor.

The sides of each rotor are substantially defined by two radial planes through the axis 100 at an angle equal to a predetermined angle by a small angle less than 360/2N° where N is the total number of diaphragms. In the example shown in FIG. 1, N is 4 therefore the angular width of each diaphragm is approximately equal to (45° – e°) where e is the aforesaid small angle. The outside corners of each diaphragm are shown in FIG. 1 to be beveled. The beveling of the corners of the diaphragms provides additional volume to the chamber for establishing a desirable engine compression ratio. If the sum of the volume contributed to a chamber by such beveling, $V_b$, plus the volume $V_e$ of the chamber contributed by the angle $e$ is $V_2 = V_b + V_e$ then the engine compression ratio is given by the formula $r = V_1/NV_2 + 1$ or $r = V_1/N(V_b + V_e) + 1$ where $V_1$ is the total volume of the cavity 35. If $V_e$ is set equal to zero then $r = V_1/NV_b + 1$. In the present example if we were to assume a ratio $V_1/V_b = 32$, $N = 4$ the resulting compression ratio would be $r = 9$.

SEALING ELEMENTS

While in theory the body of the diaphragms could be in direct sliding contact with the internal surface of the housing and with the cylindrical surface of the other rotor, in practice it will be found convenient to separate the body of the diaphragms and the surfaces of the cavity 35, on which the diaphragms are sliding, by sealing elements. FIG. 1 shows such sealing elements 39*a*, 39*b*, 39*c*, 39*d*, 39*e*, 39*f* and 39*g*. In particular, with reference to the cavity diaphragm 34*a* there are shown two sets of sealing elements running substantially parallel to each other. One set the sealing elements includes two vertical sealing elements, one element 39*g* for sliding against the surface 29*b* and another vertical sealing element 39*e*, not shown in FIG. 1, for sliding against the rotor surface 37. Same set also includes two horizontal sealing elements one being the element 39*e* sliding against the surface 29*h* of the top base of the housing 29*c*; and a second such sealing element not shown, for sliding on the inside surface 29*e* of the bottom base of the housing 29*d*.

Figure 6:
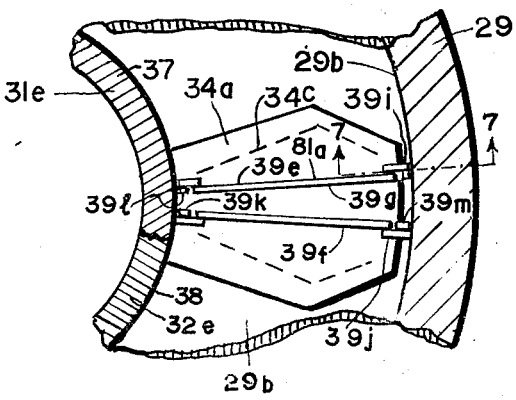
FIG. 6 is a partial horizontal cross-sectional view of the engine taken along line 6—6 of FIG. 1 showing the positioning of sealing elements on the body of cavity diaphragms.
Figure 7:
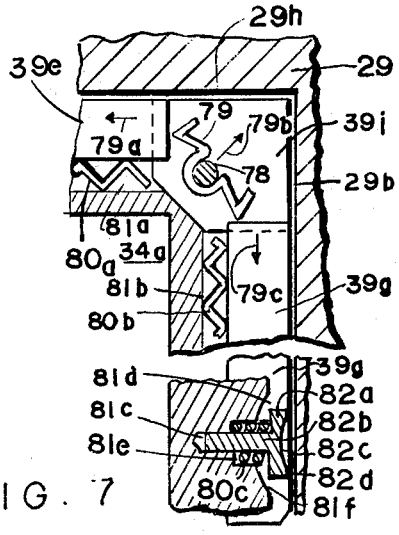
FIG. 7 is a magnified partial vertical cross-sectional view taken along line 7—7 of FIG. 6, showing the physical relationship of a horizontal, a vertical and a corner sealing element and associated springs and block.

The preferred construction of the sealing elements is shown in greater detail in FIGS. 6 and 7. FIG. 6 shows a top view of the cavity diaphragm 34*a*, with the dashed line 34*c* indicating that the diaphragm is substantially hollow for a reduction in the amoutn of moment of inertia contributed by the diaphragm. FIG. 6 shows the relative positions of the sealing elements 39*e*, 39*l*, 39*m* and corner sealing elements 39*i* and 39*j* with respect to surface 37 of the rotor 31 and surface 29b of the housing 29.

FIG. 7 shows the corner assembly of 3 sealing elements, 39*e*, 39*i*, and 39*g*. The sealing elements are substantially thin metalic strips movably inserted in grooves along the surface of the diaphragms. In particular FIG. 7 shows a sealing element 39*e* inserted in a groove 81*a* and an element 30*g* inserted in a groove 81*b*. Springs 80*a* and 80*b*, exert forces on the sealing element 39*e* and 39*g*, respectively, towards the surface on which they slide thus causing the sealing elements to remain in contact with the surface on which they slide. Partially overlapping with a horizontal and a vertical sealing element at the corner where they meet are corner sealing elements such as 39*i* shown in FIG. 7. A spring arrangement including a spring 79 operating in connection with a short post 78 which is rigidly attached to the corner element 39*i*, simultaneously provides three useful forces. A first force shown by the arrow 79*a* forces a horizontal element such as 39*e* towards a rotor such as 31, a second force in the direction of the arrow 79*c* forces a vertical element such as 39*g* towards the opposite base of the housing and a third force in the direction of the arrow 79*b* forces the corner element 39*i* towards the corner of the cavity 35.

The side of each element which is to provide sliding contact with a surface can be ground to match the curvature of such surface for most efficient sealing and less wear of the edge of the sealing element and the surface. It should be noted that the rotors, including the diaphragms, are rotatably supported with respect to the housing and with respect to each other by efficient bearings so that no radial forces are applied onto the sealing elements either by the hot gases in the expanding chambers or through the center shaft. This is a very important feature of the invention because the frictional losses between two sliding surfaces are proportional to the normal forces pressing the two surfaces together. In the invention such forces are provided only by the springs such as 80*a*, 80*b*, and 79, and centrifugal forces acting on the sealing elements. The magnitude of the centrifugal forces can be kept small by designing the sealing elements to have as small a mass as possible and the forces, applied by the springs can be kept as small as we please by using weak springs.

Because of the coaxial and concentric geometry involved in the rotors and sliding surfaces, the height of the sealing elements extending between a diaphragm and the opposite surface can be as small as the manufacturing tolerance and heat expansion tolerances are of the surface with respect to the axis. Therefore the total azimouthal forces on the sealing elements exerted by the hot gases can be relatively small because the area of the sealing elements exposed to the gaseous pressure can be small. Conversely the strength of the sealing element can be high because the ratio of height of the element exposed to the gaseous pressure over thickness of the element can be a small number.

LUBRICATION

The invention permits continuous lubrication of the sealing elements and associated surfaces. This is possibly due to the feature of the invention permitting whole surfaces to be common to both diaphragms and cavity surfaces. Referring back to FIG. 1 a lubrication arrangement is shown where the lubricating oil runs from an inlet 61 on one side of the housing 29*f* through one rotor 31 around each diaphragm between sealing elements such as 39*f* and 39*e* and a surface such as 29*b*, through the other rotor 32 and through an oil return 66. In particular the oil entering the inlet 61 can flow through a radial canal 62 in the housing base 29*c*. The canal 62 brings the oil to a channel 63, circumferentially disposed around the cylinder 31a of the rotor 31. Canals such as 64 and 64*a* then connect the channel 63 with a channel 38 formed between two rows of sealing elements and the portion of the surface of the cavity of revolution 35 opposite the row of sealing elements. The channel 38 ends up in the rotor 32 where canals such as a canal 64*b* permits the oil to reach a channel 67, similar to the channel 63 but this one now circumferentially disposed around the rotor 32. A canal 65 through the other base 29*d* of the housing then permits the oil to go from the channel 67 to the oil return outlet 66. The oil travels in parallel paths between the channels 63 and 67 so that the walls of the cavity 35 can be independently oiled by the channel of each diaphragm.

A problem presents itself at the spots where an oil channel formed by two rows of sealing elements slides over a fuel intake or exhaust port or a spark plug opening on the housing, where oil would be spilled and therefore get lost in the port or opening. A solution to this problem is a bypass block 82*a* filling the length of the channel over the length of the opening and having a channel underneath for allowing the oil to pass over the opening without being spilled in the opening. A detail of the bypass block arrangement is shown in the lower part of FIG. 7. A block 82*a* having substantially the shape of an orthogonal parallelogram is long enough along the direction of the flow of the oil channel to cover a particular opening on the housing. The width of the block 82*a* is adjusted substantially to the width of the channel 38 between the two sealing elements, such as 39*g* and 39*m*. A channel 81*d* is dug onto the wall of the diaphragm for the oil to pass under the block 82*a*. The outer surface 82*d* of the block 81*a* is ground to conform to the curvature of the surface on which it slides and may also provide an undercut 82*c* for reducing friction due to surface imperfections. The block 82*a* is rigidly supported by a post 82*b* which in turn is held in sliding contact inside a hole 81*c* provided on the wall of the diaphragm. The hole 81*c* is undercut into a large diameter hole 81*e* for providing space for a spring 80*c* forcing the block 82*a* towards the surface having the opening.

Lubrication of the bearings such as 41, 43, 44, 47, and 42 may be easily accomplished by canals drilled through the rotors, not shown, for connecting the aforesaid oil path with these bearings. Lubrication of the gear assembly 46 may be easily accomplished by a splashing bath of oil retained inside the hollow cylinders 37 and 38.

STROKES AND CYCLES

The engine provided by the invention has the property of being capable of performing a variety of thermodynamic cycles. Before I describe how the engine can perform complex cycles, I will demonstrate here how the engine can perform the well-known Otto cycle including four cycles A, B, C, D, representing suction, compression, power and exhaust, respectively. The Otto cycle engines are well known also as gasoline engines. The Otto cycle is demonstrated with reference to the FIGS. 2*a*, 2*b*, 2*c*, 2*d*, 3 and 4, showing the successive strokes ABCD. Referring now in particular to FIG. 2*a*, it shows the rotor 31 having two diaphragms 33*a* and 33*b* and rotor 32 having two diaphragms 34*a* and 34*b*. The diaphragms on each rotor are equiangularly disposed around the rotor so that each rotor is rotationally self-balanced. Further the diaphragms of one rotor are interleaved and therefore alternated with the diaphragms of the other rotor so that if the two rotors 31 and 32 are forced to rotate with respect to each other the volume of all chambers formed between any two successive diaphragms and the wall of the cavity of revolution 35 varies, the volume of half the chambers increasing while the volume of the other half of the chambers equally decreasing. The cavity of revolution 35 is shown in FIG. 2*a* to be oriented with respect to eight imaginary axial radial planes along the radii 0-1, 0-2, 0-3, 0-4, 0-5, 0-6, 0-7, and 0-8, with 0 being coincident with the axis 100. These planes contain the axis 100—100 and divide the cavity 35 into eight equal volumes the position of each now being defined with respect to the housing 29. During a first stroke time interval the rotor 32 with the diaphragms 34*a* and 34*b* undergo a rotational displacement from the position where the diaphragm 34*a* lies between planes 0-1 and 0-2, shown in FIG. 2*a*, to a new position, shown in FIG. 2*b* where 34*a* lies between planes 0-3 and 0-4. In so doing the rotor 32 is rotated approximately 90°, in the clockwise direction which I will assume in this description to represent the forward direction. During the first stroke, assuming that the rotor 31 will remain substantially still, the volume of the chamber containing the plane 0-1 increases; therefore this chamber can be assigned stroke A, sucking a mixture of carburated air from the carburator through the intake port 174*a*. Simultaneously the volume of the chamber containing the plane 0-4 decreases; therefore this chamber can be assigned stroke B, performing compression of the carburated air. Also simultaneously the volume of the chamber containing the plain 0-5 is increasing therefore this chamber can be assigned stroke C, the power stroke. During this stroke the carburated mixture is ignited by a spark-plug 90*e* and the hot gases act on the walls of both diaphragm 34*b* and 33*a*, forcing the rotor 32 to rotate in the forward direction, the rotor 31 in the reverse direction. We will see later that the engine provides means for limiting the motion of any rotor in the reverse direction. The work done by the expanding gases in the chamber of plane 0-5 therefore results in approximately a 90° rotation of rotor 32. Finally, also simultaneously, the volume of the chamber containing the plain 0-8 decreases; therefore this chamber can be assigned the stroke for expelling the exhaust gasses through the exhaust port 75*h*. At this point we may summarize that by the motion of a single rotor 31 through 90° in the forward direction, the four chambers around the cavity 35 each performed one of the four strokes in the Otto cycle.

At the end of the first stroke the position of the rotors is as shown in FIG. 2*b*. The shaft 46 of the intermediate bevel gear and therefore the center shaft 40 has rotated by 45°, which is the average rotation of the two rotors $(0 + 90)/2 = 45°$. It may be noted that the various chambers in the engine have been adequately identified by the plane which has been contained in the chamber during the entire duration of the stroke. This is a convenient method of defining chambers and will be used in the remainder of this specification.

When the planes, representing chambers, are referensed to time in stroke units and each chamber is assigned its particular stroke, a table such as the one shown in FIG. 3 results. Note in FIG. 3 the assignments A, B, C and D, given above to the chambers represented by the plains 0-1, 0-4, 0-5, and 0-8, respectively during the first stroke time interval.

FIG. 2*b* shows the position of the diaphragms and the center shaft at the beginning of the second stroke time interval. Now the chamber of plane 0-8 will perform stroke A, the chamber of plane 0-3 stroke B, the chamber of plane 0-4 stroke C and the chamber of plane 0-7 will perform stroke D. We see therefore that the stroke pattern has rotated by 45° in the reverse direction while the net result has been rotation of the center shaft 45° in the forward direction. Similarly during the third and fourth stroke time intervals the stroke pattern is rotated another 45° in the reverse direction and the center shaft 45° in the positive direction for each stroke time interval as shown in FIG. 3 and verified by the inspection of positions and stroke phases in FIGS. 2*c* and 2*d*. At the end of four time stroke intervals each rotor will have rotated 180° and therefore the center shaft will also have rotated 180°. It will take an additional four time strokes, that is a total of eight time strokes, before each rotor and the center shaft will have performed a complete revolution, and the positions of the rotors and center shaft to be exactly as shown in FIG. 2*a*. FIG. 3 shows the plane-stroke pattern for such eight-time stroke intervals.

The Wankel Engine has been claimed to utilize volume twice as efficiently as a four-cylinder piston engine because it provides one power stroke per revolution of the output shaft; while a four-cylinder piston engine provides only half a power stroke per revolution of the output shaft. Since, as shown above the invention provides eight power strokes per revolution of the center shaft, an output shaft can be conveniently geared up by a ratio of four to one with the invention still providing two power strokes per revolution of the output shaft, implying twice as good a volume efficiency than that of the Wankel engine. The engine in accordance with the invention, however, will only have to run three-quarters of the speed of the Wankel, implying less wear. If the engine provided by the invention is to provide only one power stroke per revolution the output shaft may be further geared up by a ratio of two to one with the center shaft and each of the rotors of the invention having to run only three-eighths the speed of the Wankel engine rotor, for even less wear and higher efficiency. Lower speed implies less turbulance in the flow of gases in the chambers. I will discuss later in this description how complex cycles which can be performed by the invention can help to extract more energy out of the same amount of fuel.

FIG. 4 shows a PRESSURE-VOLUME diagram of the invention when operated in an Otto cycle. The classical Otto cycle is represented in FIG. 4 by the solid curve sections AA′, BB′, B′CC′, C′DD′, representing the pressure-volume relationship in a chamber undergoing the four strokes A, B, C and D, respectively. In the present invention, when used in an Otto cycle, there is a deviation in the Pressure-Volume relationship shown in FIG. 4 by the dashed line. The deviation from the classical Otto cycle comes into play because while in the piston engine after the explosion the piston is pushed forward against a stationary cylinder base, in the case of the invention, a diaphragm is pushed forward against a diaphragm of the other rotor, the latter possessing a certain amount of angular momentum. By the time the explosion occurs the previously moving diaphragm may move further than point B′ to a point B″ thus further increasing the compression ratio. It will take a portion of the power cycle to completely stop the previously moving rotor. During this time, we are confronted with a conservative field of force where the entire momentum of the previously moving rotor is being transferred to the other rotor, with no energy losses due to this transfer. Putting it in another way, the rotor being establishes forward due to the fuel explosion will receive more force because of the rotational momentum of the other rotor than it would have had received had the other rotor been stationary. This additional force is totally used to accelerate the moment of inertia of the other rotor, assuming the rotors have same amount of moment of inertia. The equalization of the moment of inertia in the two rotors can be easily accomplished by adjusting the differential gear assembly 46 about half way between the two bases, 29*c* and 29*d*, with appropriate portion of the cylinder 32*d* being shifted as cylinder 31*d*, not shown, between the cylinder 31*a* and the bevel gear 31*c*.

Soon after the explosion from the point C″ in FIG. 4 the dashed line C″C‴ crosses the CC′ line. At this point complete transfer of the rotational momentum has occurred from the previously moving rotor to the other rotor. The first rotor comes to a stop and starts moving in the reverse direction until it is stopped from doing so by means such as a pawl and ratchet or a wire-wrapping arrangement, to be described later in this description. From then on, the input energy is changed to torque. While it will be advantageous to keep the moment of inertia of the rotors as low as possible, it should be noted that the starting and stopping of the rotors involves only lossless transfer of momentum. Unlike the piston engine, where the Kinetic energy of the pistons is dissipated against the bearings on the crankshaft, therefore contributing to frictional losses, in the case of the invention the process of stopping and accelerating rotors does not increase frictional losses and therefore we have lossless transfer of energy from one rotor to the other.

It should be noted that the velocity of the center shaft 40 is not changing because of stopping one rotor and accelerating the other. For if we are to assume that the rotational velocity of the first rotor, before the explosion and with the second rotor stationary, was $W_0$, the rotational velocity of the center shaft being the average of the velocities of the two rotors was $\overline{W} = (W_0 + 0)/2 = W_0/2$. During the time t of exchange of momentum between the two rotors, the approximate velocity of the first rotor at any instant t seconds after the fuel explosion will be given by $W_1 = W_0 - at$, a being the rotational acceleration. The velocity of the second rotor at same t seconds after the fuel explosion will be given by $W_2 = (0 + \overline{at})$ assuming the two rotors are having same moment of inertia, with the force due to the fuel pressure on the two diaphragms being equal and opposite. The velocity of the center shaft at time t seconds after the fuel explosion will be $\overline{W} = (W_1 + W_2)/2 = (W_0 - at + 0 + at)/2 = W_0/2$ which is not a function of $t$ and therefore is a constant.

PORT OPENING AND CLOSING SYSTEM

FIG. 3 shows that the stroke pattern rotates an angle of 45° in the reverse direction for every stroke time interval. The rotation of stroke pattern is a property of the invention true for any cycle with any number of strokes; it is demonstrated later in this description with reference to an eight-stroke and a complex 10-stroke cycle. The direction in which the sequence of strokes ABCD . . . in a cycle is originally assigned to the sequence of chambers around the axis of the engine is optional; it may be assigned in the clockwise or counterclockwise direction. But once this assignment is made, the stroke pattern ABCD . . . will rotate an angle of 180/N in the direction opposite to the direction of the aforesaid assignment, where N is the total number of diaphragms in the engine. This has nothing to do with the direction in which the center shaft will rotate. The direction of rotation of the center shaft solely depends on and is same as the direction in which the rotors are allowed to rotate freely; that is opposite to the direction in which the rotation of rotors is being restricted. In this description the center shaft 40 is set to rotate in the clockwise rotation which is considered the positive rotation. In this description the sequence of strokes ABCD . . . is being assigned in clockwise direction as shown in FIG. 2*a*, and thereforre the stroke pattern ABCD . . . rotates an amount 180/N per stroke time interval in the counterclockwise direction.

The pattern rotation property of the invention makes possible convenient arrangements for controlling the opening and closing of the intake and exhaust ports of the chambers. In the position engines the opening and closing of the intake and exhaust ports is accomplished by means of a system of valves. The accepted configuration of the valve system includes the actual valve situated at the end of a valve rod, which is under spring tension to keep the valve at the position normally blocking the opening of the port. The motion of the valve occurs in the general direction of the axis of the valve rod with constraints usually provided in the radial direction. A rocker arm supported on a pivot acts as a lever forcing the valve rod to move against the tension of the spring and thus opening the port under the influence of a cam rod whose motion is timed with reference to the rotation of the crank shaft.

A system of valves similar to those used in the piston engines can be used in connection with the engine provided by the invention. One intake and one exhaust valve would be needed on the wall of the housing along each of the planes 0-1 to 0-2N. The engine shown in FIGS. 1 and 2*a* would require 16 valves, eight intake and eight exhaust valves, a pair along each of the planes 0-1 to 0-8. Whether the intake and exhaust ports are positioned on one of the bases such as 29*c* or 29*d* or on the outer cylindrical section 29*a* or the intake ports are positioned on one base such as 29*c* while the exhaust ports are positioned in the other base such as 29*d*, is a matter of choice, depending on both technical and topological considerations, examples of the latter being the orientation of the engine with respect to a drive shaft, a carburator and an exhaust muffler. An example of a valve arrangement would be to have the intake ports and therefore valves on the top base 29*c* and the exhaust ports with valves on the bottom base 29*d*. The valve rods could be supported parallel to the axis 100 through holes on the two layers of the housing such as 29*c* and 29*f*. The depression of the valves then for opening a port can be accomplished by means of wobble plates or similar cam means securely attached onto and rotated by the center shaft. The wobble plates or similar means providing cam action, may act preferably on rollers provided directly on the valve rods or preferably on rollers installed on the driven point of rockers which in turn would drive the valve rods. The rollers can serve to reduce friction and side thrust.

PORT REGULATING PLATE

Figure 5:
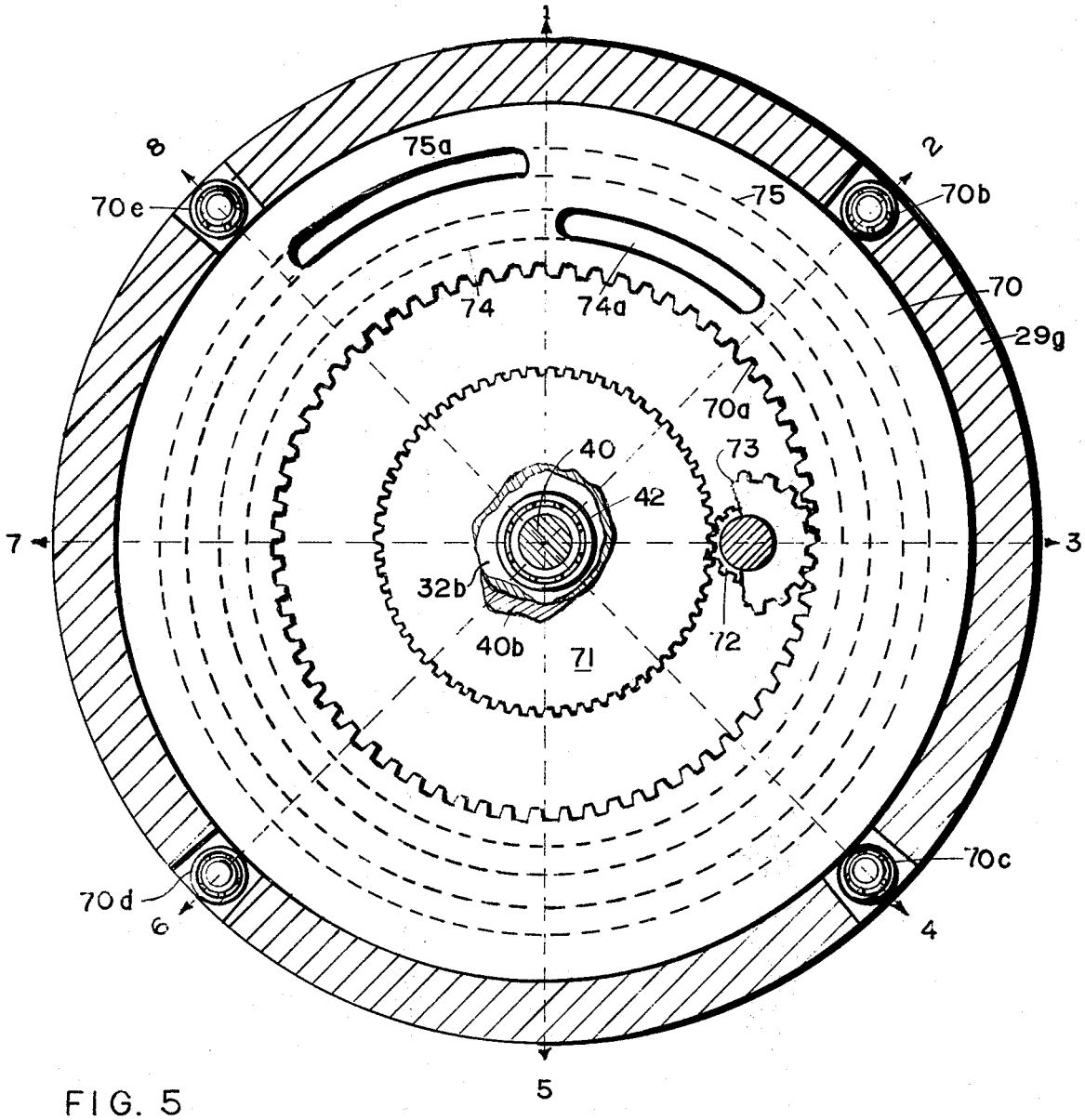
FIG. 5 is a horizontal cross-sectional view of a portion of the invention taken along a line 5—5 of FIG. 1 showing a preferred form of a port control plate used to regulate the opening and closing of fuel and air intake and exhaust ports through preprogrammed channels and slots and showing its relative motion in relation to a center shaft and its relative timing with respect to the housing when the invention is used in an Otto cycle; with portions of the engine broken away for revealing associated gearing, and bearings.

FIGS. 1 and 5 show a preferable method of controlling the opening and closing of intake and exhaust ports. This method provides for at least one port regulating plate 70 either directly attached and rotated by the center shaft or rotatably supported with respect to the housing and being rotated through gears by the center shaft 40. The direction of rotation of the plate 70 has to be the same as the direction of rotation of the ABCD . . . stroke pattern, previously discussed. The plate 70 can be arranged to rotate in the same direction or opposite direction than the center shaft 40. In FIGS. 1 and 5 the center shaft 40 is set to rotate in the positive, clockwise, direction and the port regulating plate 70 to rotate in the reverse, direction through gears 71 and 72; the plate 70 itself being circumferentially disposed around a planetary gear 70*a*.

FIG. 5 is a plan cross-sectional view showing the port regulating plate 70 in relation to the housing 29*g*, the center shaft 40 and the gears 71, 72, 73 and the planetary gear 70*a*. The plate 70 contains through slots 74*a* and 75*a* at predetermined radial distances from the axis 100 and along predetermined arcs. The slots 74*a* and 75*a* are cut along circumferential channels 74 and 75, respectively, the channels being on the outer side of the plate 70. The plate 70 is held properly aligned with respect to the center shaft by means of at least three bearings such as bearings 70*b*, 70*c*, 70*d*, and 70*e*. It is a matter of choice whether the shafts of such bearings are based on the housing with the rim of the bearing rolling on the rim of the plate 70 as shown in FIG. 5; or the shafts are held by the plate 70 and the bearings role over the cylindrical inside surface of the housing 29*g*.

FIG. 1 shows the vertical position of the port regulating plate 70, in relation to the housing 29*g*, the intake and exhaust ports 76 and 77, respectively, and the gears 71, 72, 73, and 70*a*. The plate 70 rotatably fits and substantially takes the space between the base 29*d* and the extended base of 29*g*. The channel 74 is in continuous communication with the intake port 76, and the channel 75 is in continuous communication with the exhaust port 77. On the base 29*d* there are pairs of openings such as 174*a* and 175*a*, shown in FIG. 2*a*, one for intake and one for exhaust, respectively, along each plane 0-1 to 0-8. As the plate 70 rotates it established communication between one of the chambers, through a hole such as 174*a*, through the channel 74, and through the intake port 76 connected to the carburator; simultaneously it established communication through a hole such as 75*i*, through the channel 75, and through the exhaust port 77 normally connected to an exhaust pipe, through a muffler. The rotational orientation of the plate 70 shown in FIG. 5 corresponds to the orientation of the rotors in FIG. 2*a* when the chamber at plane 0-1 starts performing stroke A. FIGS. 2*a*, 2*b*, 2*c*, and 2*d* show the intake and exhaust openings created by the port control plate 70 as nonshaded holes; whereas where the top face of the plate 70 covers the port the hole is shown shaded.

It should be noted that separate control plates could be used for intake and exhaust in case the choice was to be made for having the intake ports on one base such as the base 29*c* and having the exhaust ports on the other base, such as the base 29*d* shown in FIG. 1. The second control plate can be operated in a similar manner as the first plate already described above; but the second plate would be installed within the extending housing 29*f*.

The main reason for selecting the gear-driven alternative for the port regulating 70 versus having the plate 70 directly attached to the center shaft 40, is because in this approach the plate 70 can conveniently be located out of the way inside the housing extension 29*g* and because the gears 71 and 72 involved can also be used for gearing down the center shaft 40 with respect to an output shaft 72*a*. The shaft 72*a* is also used for communicating the rotation of the gear 72 to the gear 73.

ROTOR REVERSE MOTION LIMITING MEANS

It has been explained above that during each power stroke the two rotors 31 and 32 are forced to rotate, one in the positive direction the other in the reverse direction. It has been explained further that the motion of the rotor being forced in the reverse direction is limited by reverse motion limiting means provided by the invention. Such reverse motion limiting means may be provided in terms of a pair of wire-wrapping units, one for each rotor, not shown, wherein wires having one end securely attached to the housing and wrapped around the cylinders 31*a* and 32*a* tend to wind and thus prevent the rotors from rotating in the reverse direction; but allow the rotors to rotate in the forward direction in which the wires tend to unwind. Wire wrapping units are known however to involve critical parameters such as the tightness of the winding around the cylinder in the reverse direction the time before total wrapping is accomplished and the extent of metal fatigue the unit will suffer with time. For these reasons, I show in FIGS. 1, 9*a*, and 9*b*, a pawl and ratchet arrangement operating between each rotor and the housing, as the preferred method for limiting the reverse motion of the rotors.

Figure 9A:
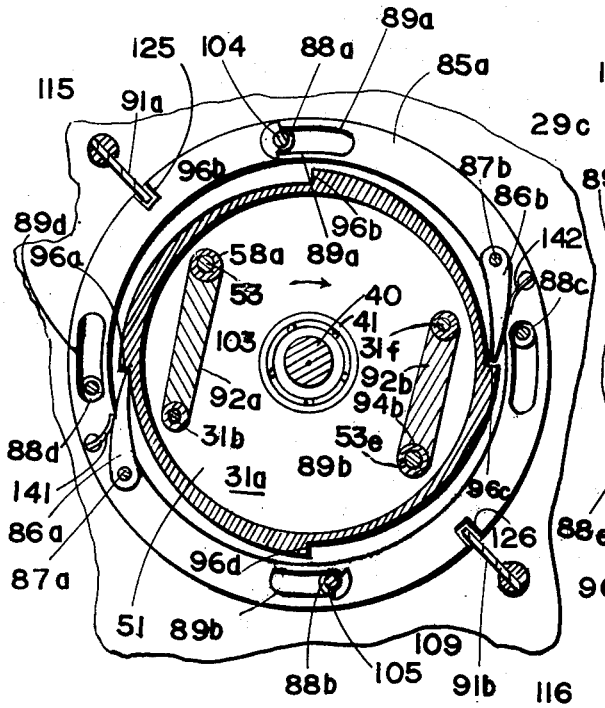
FIGS. 9*a* and 9*b* are partial horizontal cross-sectional views of portions of the invention taken along lines 9*a*—9*a* and 9*b* —9*b*, respectively of FIG. 1 showing pivoting roller supports of the rollers also shown in FIGS. 8*a* and 8*b*, and also showing spring loaded plate in conjunction with rachet and pawl arrangements for limiting the rotational motion of either rotor in the reverse direction.
Figure 9B:
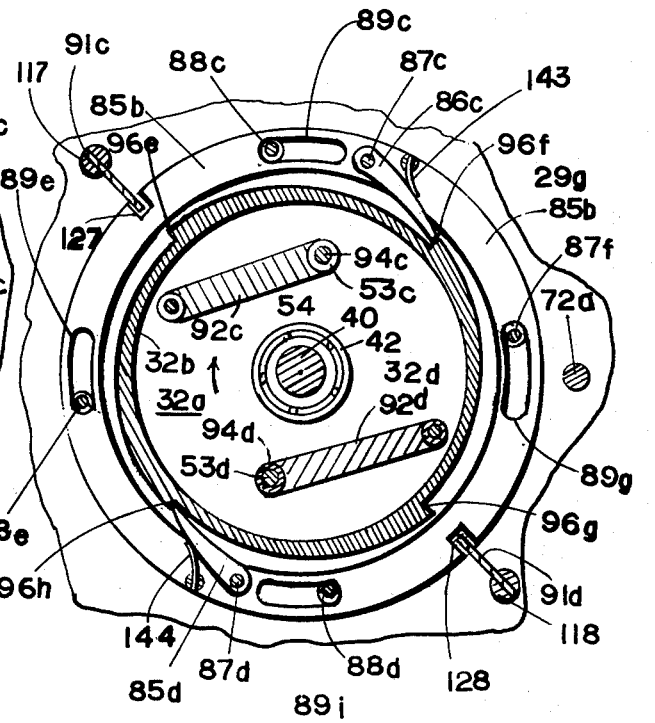

FIGS. 9*a* and 9*b* illustrate in detail the operation of the pawl and ratchet arrangements for limiting the reverse rotation of the rotors 31 and 32, respectively. In FIG. 9*a* the cylinder 31*a* of the rotor 31 is shown to provide ratchet steps 96*a*, 96*b*, 96*c*, and 96*d* about 90° apart as means for engaging with pawls 86*a* and 86*b*. The pawls 86*a* and 86*b* are pivoted on posts 87*a* and 87*b*, respectively, as their tip is operated by the ratchet steps on the cylinder 31*a* under the influence of springs, such as 141 and 142. The posts 87*a* and 87*b* and the springs 141 and 142 are rigidly supported on a round plate 85*a*, circumberentially disposed around the cylinder 31*a* and partially, rotatably, supported by the housing 29*c*. When the rotor 31 attempts to rotate in the counterclockwise direction subsequently to the pawls 86*a* and 86*b* falling over the ratchet steps such as 96*a* and 96*c*, respectively, it is prevented from doing so by the pawls operating against the ratchet steps, the pawls being forced in the counterclockwise direction, forcing in turn the pate 85*a* in the same direction. The motion of the plate 85*a* is constrained to be a rotational motion by means of rollers such as 88*a*, 88*b*, 88*c*, and 88*d* whose shafts, such as 104 and 105, are rigidly supported by the housing 29*c;* the rollers operating inside slots such as 89*a*, 89*b*, 89*d*, cut on the plate 85*a*.

The rotational displacement of the plate 85*a* is limited by the force of springs such as 91*a* and 91*b* operating inside notches 125 and 126, respectively. In this way, the reverse motion of the rotors is brought to a stop smoothly under the influence of the springs 91*a* and 91*b*. It should be noted that the distortion of the springs 91*a* 91*b* is accomplished in a symmetric pair of force arrangement, smoothly storing kinetic energy and force into potential energy on to the springs, to be subsequently returned to the rotor with only insignificant frictional losses. No radial forces which could substantially increase friction are exerted on any of the bearings due to the stopping of the rotors. The azimuthal positions of the ports such as 104 and 105 with respect to the housing and of the ratchet steps such as 96*a*, 96*b*, 96*c*, and 96*d* with respect to the diaphragms 33*a* and 33*b* are predetermined so that the rotor is stopped with its forward side a predetermined angle *e* from the planes 0-1 to 0-8. FIG. 9*b* shows a similar arrangement to that described in connection with FIG. 9*a* for limiting the motion of the rotor 32 in the reverse direction; comprising: spring loaded pawls 85*d* and 86*c* operating with ratchet steps 963, 96*f*, 96*g*, and 96*h;* a round spring loaded plate 85*b* circumferentially disposed about the cylinder 32*a;* rollers such as 88*c*, 88*f*, and 88*e* operating in slots such as 89*c*, 89*g*, 89*e* whereby the motion of the rotor 32 is smoothly stopped and is converted into potential energy stored in springs such as 91*c* and 91*d*, to be subsequently returned as kinetic energy on the rotor 32. It should be noted, however, that the azimouthal position of pawls 85*d* and 86*c* is offset from the azimouthal position of the pawls 86*a* and 86*b* by an angle equal to $360/N = 45°$, with respect to the housing.

STARTING AND MISFIRING CONTROLS

A basic requirement of any engine is its capability of being started. Most gasoline engines and, a category of diesel engines are being started through torque provided by an electric starter motor onto the output shaft of the engine. Since such torque would apply equal forces to both rotors of the invention, means are needed for regulating the predetermined displacements of the rotors. A similar situation arises in case of misfiring where the internal forces from the fuel forcing one rotor in the reverse direction are absent, and forward torque is transmitted from rotational momentum stored in the load to both rotors.

Figure 8A:
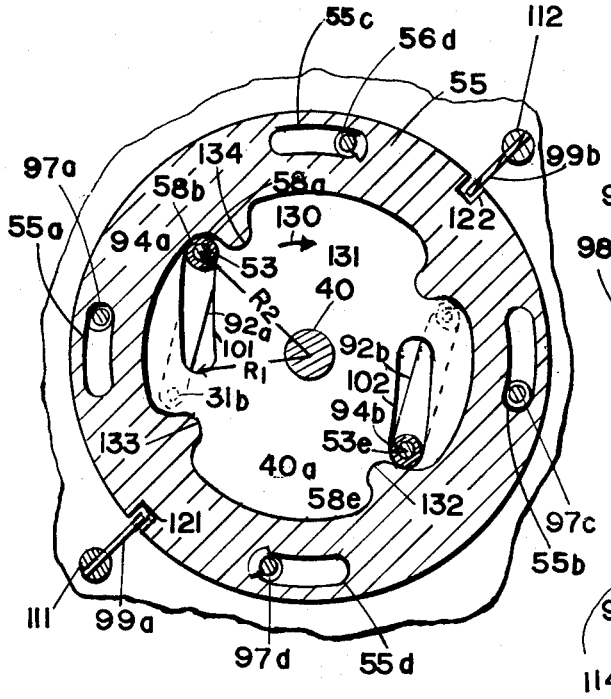
FIGS. 8*a* and 8*b* are partial horizontal cross-sectional views of portions of the invention taken along lines 8*a*—8*a* and 8*b*—8*b*, respectively of FIG. 1; with obstructing parts removed for revealing the positional relationship of spring loaded protrusion plates, rollers and slots, limiting the rotational excursion in the forward direction of the rotors during starting or misfiring of the engine.
Figure 8B:
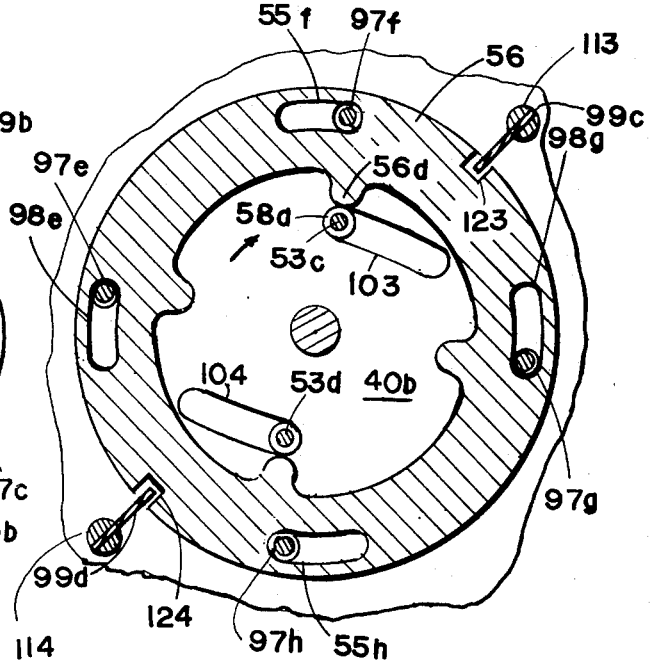

FIGS. 8*a* and 8*b* illustrate a method by which such regulation of the rotors can be accomplished in the invention. Referring now to FIG. 8*a* it shows a pair of slots 101 and 102 on the cylinder 40*a* which is rotating with the center shaft 40. These slots extend approximately 45° over the face of the cylinder in the azimuthal direction, and also extend a distance $(R_2 - R_1)$ in the radial direction. A pair of posts 53 and 94*b* supporting rollers such as 58*a*, 58*b* and 94*b* extends substantially parallel to the center shaft 40, from the cylinder 31*a* and through the slots 101 and 102, respectively. The rollers such as the roller 58*a* have a diameter slightly smaller than the width of the slots, such as the slot 101 so that they may roll against the side of the slots. The posts 53 and 94*b* are firmly supported by arms 92*a* and 92*b*, which in turn, as shown in FIG. 9*a*, are pivoted about pivoting posts 31*b* and 31*f* as the rollers such as roller 58*a* roll along the edge of the slots, such as the slot 101. The pivoting posts 31*b* and 31*f* are firmly arrached onto the face of the cylinder 31*a* with the arms 92*a* and 92*b* operating within a circular depression 51 on the face of the cylinder 31*a*. Returning now to FIG. 8*a*, a round plate 55 is shown circumferentially disposed about the center shaft 40 and having short protrusions 131, 132, 133, and 134 radially extending towards the center shaft 40. The plate 55 is rotatably constrained by an arrangement of rollers 56*d*, 97*a*, 97*c*, and 97*d*, operating inside slots 55*c*, 55*a*, 55*b*, and 55*d*, respectively, in a similar arrangement to that previously discussed in connection with the round plate 85*a* of FIG. 9*a*. The round plate 55, FIG. 8*a*, is spring loaded by springs 99*a* and 99*b* operating in notches 121 and 122 respectively.

I will now describe the operation of the means for regulating the displacements of the rotors during starting and misfiring, in detail. Referring again to FIG. 8*a*, let us assume that the post 53 and therefore the rollers 58*a* and 58*b* are at the rear end of the slot nearer the center shaft 40, a distance R1 from the Axis 100—100 at a time when the rotor 31 is to start a first forward stroke displacement, in the direction of the arrow 130. Because of the engagement of the center shaft and the rotors through the differential gear assembly 46 of FIG. 1, the post 53 rotating with the rotor 31, will travel approximately 90° while the slot 101, on the cylinder 40*a* also being used as a post-guiding plate rotating with the center shaft 40, will only travel approximately 45°, assuming for the moment that the rotor remains stationary. The post 53 will therefore, during the first stroke, traverse the angle 45° which will be covered by the cylinder 40*a* and the slot 101, plus it will traverse an additional 45° angle. Thus it is moving inside the slot 101 from the rear end of the slot to the forward end of the slot 101 and to a distance from $R_1$ to $R_2$ from the axis 100—100, with the position of the post 53 and of the slot 101 with respect to the round plate 55 at the end of the first stroke time interval, being as shown in FIG. 8*a*. At this position, a roller 58*b* on the shaft 53 meets the protrusion 134 causing the rotor 31 to stop smoothly against the spring loading of the plate 55 by the springs 99*a* and 99*b*. At the end of such a stroke and the beginning of the second stroke, a similar arrangement to that described in connection with FIG. 8*a*, is operating on the other rotor 32 as shown in FIG. 8*b*. At the beginning of the second stroke, the roller 58*d* is at the rear end of a slot 103 at a distance $R_1$ from the axis 100—100. Therefore, it is unobstructed by a protrusion 56*d*, it can move forward 90° with respect to the plate 56 and 45° with respect to the cylinder 40*b* along the length of the slot 103, during the second stroke; while the motion of the rotor 31 is obstructed by the protrusion 134. During the second stroke, however, the cylinders 40*a* and 40*b* will keep rotating and at the end of the second stroke the slot 101 will have advanced 45° and with the roller 58*b* not moving in the azimouthal direction the roller 58*b* will therefore effectively move along the edge of the slot 101 to the rear end of the slot 101, at a radius $R_1$ from the axis 100—100. Therefore the roller 58*b* will again be unobstructed by the protrusion 134 during a third stroke, and the process will be repeated so that during each odd number of stroke time intervals the rotor 31 will be allowed to rotate while during the even number of stroke time intervals the rotor 32 will be allowed to rotate. The elements such as pawls and ratchets, rollers and slots, springs, and rollers and protrusions discussed above are used for applying action and being subject to forces associated with reaction, to the rotors. While strictly speaking a single element of each such kind of element per rotor could be adequate, using at least two of each of such elements, symmetrically, with respect to the center axis 100—100 is a preferable way, forming well balanced pairs of forces, for avoiding radial strains, for less wear and higher reliability. It should be noted that the energy provided for such rotation comes from external forces such as torque, through a shaft either from a starter motor or from rotational momentum stored in the load. As soon as the fuel ignites, the forces generated are in synchronism with the external forces and smooth disengagement of the starter and engine shafts can occur. It should be further noted that while the engagement of the posts such as 53 and 53*e* with the slots 101 and 102 is continuous, the rollers 58*b* and 58*e* do not normally interact with the protrusions 134 and 132, respectively, because opposing forces as a result of the fuel ignition normally reverse the motion of the rotors before they are stopped by the protrusions.

COMPLEX CYCLE USING HEAT FROM CHAMBER WALLS

Figure 14:
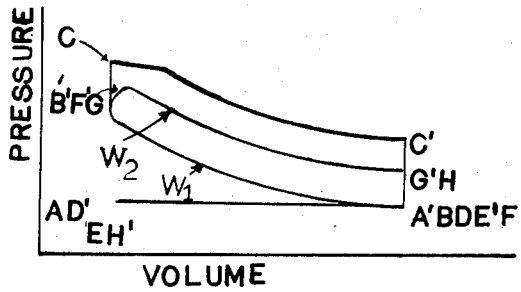
FIG. 14 is a PRESSURE vs VOLUME cycle diagram showing energy-work considerations in the eight-stroke-per-cycle example illustrated in terms of FIGS. 10 and 11.

It has been stated above that the engine provided by the invention is capable of performing complex thermodynamic cycles, which the piston engines and the Wankel engine, in their present form, could not perform. The engine in accordance with the present invention possesses two properties which enable it to be easily adapted to complex cycles. First, the fact that the number of diaphragms per rotor can be increased to 4, 5, 6 or more; and second the intake and exhaust programming of the chambers can be easily arranged by means of a port regulating plate such as the plate 70 shown in FIG. 5. The first property makes available to the design engineer a large number of chambers simultaneously operating through a sequence of strokes ABCD . . . of a cycle. A predetermined number of these strokes can be allocated for sucking cool air, compressing the air, and letting the air expand against the diaphragms of the chamber. A certain amount of work will be gained by the utilization of some of the heat trapped on the walls of the chamber during a previous fuel ignition. FIG. 14 shows strokes A,B,C, and D substantially similar to a conventional Otto cycle or Diesel cycle, but also shows additional cycles E for intaking cool air, F for compressing and heating such cool air, G for having such heated air perform work on the moving diaphragm of the engine, and H for expelling the expanded air. On intake of cool air the velocity distribution of the molecules of the air follows the wellknown Maxwellian distribution, corresponding to the cool air temperature. During the compression stroke, which follows, work $W_1$ is done on the cool air, indicated in FIG. 14 by the line FF′. The work $W_1$ changes the volume of the chamber and increases the temperature of the air. As the air is being compressed the velocity of its molecules increases and the reduction of space causes greater number of air molecular collisions with the walls of the chamber, a good part of such walls being the surface of the diaphragms. Heat energy from the walls of the chamber thus is converted into Kinetic energy in the air molecules, with the Maxwellian air velocity distribution becoming more and more concentrated around the velocity corresponding to a high chamber temperature. During the stroke G indicated in FIG. 14 by the line GG' the hot air will do work $W_2$ on the forwardly moving diaphragm, an amount ($W_2$ – –$W_1$) greater than the work which was spent in compressing the cool air. The work ($W_2$ – –$W_1$) gained not only comes free, but also offers further gains because it can affect a reduction in the cooling system needed to precess such heat.

Figure 10:
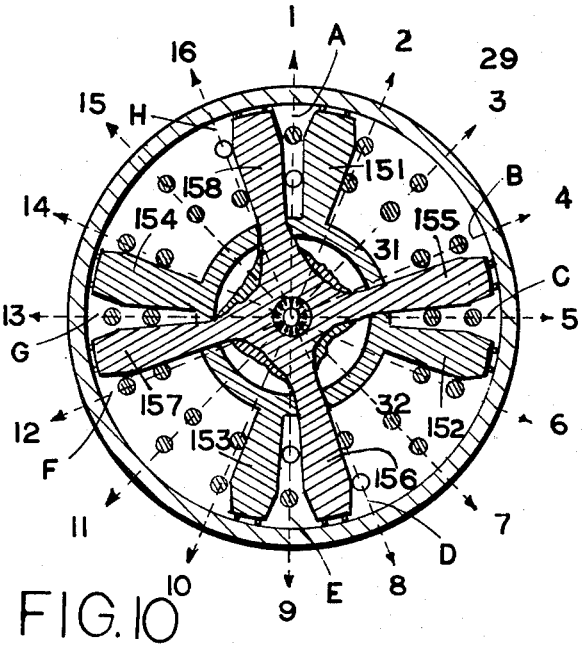
FIG. 10 is a horizontal cross-sectional view of a portion of the engine presumably taken along line 2—2 of FIG. 1 as in FIG. 2*a*, but illustrating an example where each rotor has four diaphragms providing the feasability of an eight-stroke-per-cycle engine.

FIG. 10 is a diagram substantially equivalent to FIG. 2*a*, but now describing an engine in accordance with the invention and having four diaphragms per rotor, a total of eight diaphragms 151, 152, 153, 154, 155, 156, 157, and 158. Again the chambers can be identified in terms of planes such as 0-1 to 0-16 contained in each chamber during the entire stroke. The configuration shown in FIG. 10 can be operated in various cycles. Later in this description I point out that an engine such as in FIG. 10 could be operated as a two stroke A,B cycle for a steam engine. In such a case during the first stroke time interval the chambers containing planes 0-1, 0-5, 0-9, and 0-13 would execute a power stroke A while the chambers 0-4, 0-8, 0-11, and 0-16 would execute an exhaust cycle B. Or the engine in FIG. 10 could be used in an Otto Cycle or a Diesel cycle with the chambers 0-1 and 0-9 executing stroke A, the chambers 0-4 and 0-12 stroke B, the chambers 0-5 and 0-13 stroke C, and the chambers 0-8 and 0-16 executing stroke D.

Figure 11:
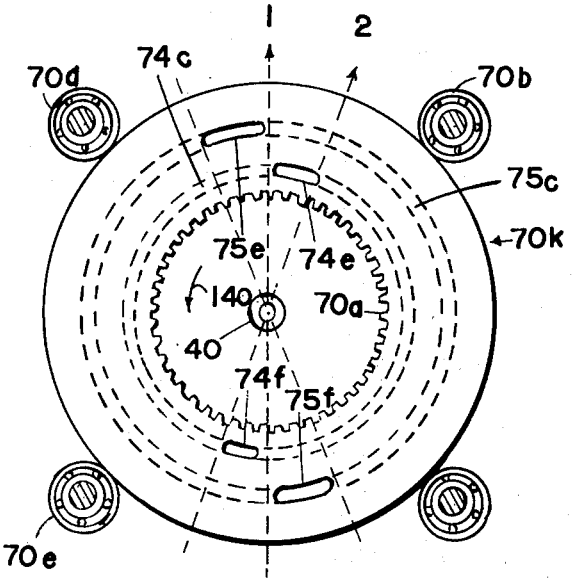
FIG. 11 is a horizontal cross-sectional view of a portion of the invention taken along a line 5—5 of FIG. 1 for illustrating the slot programming of a port control plate used in the eight-stroke cycle aforementioned in connection with FIG. 10.

FIG. 16 is a table similar to that shown in FIG. 3, but now referring to the engine shown in FIG. 10 having four diaphragms on each rotor and being operated in a complex cycle A,B,C,D,E,F,G,H previously described where A,B,C,D correspond to a classical Otto cycle or a Diesel cycle but here extended by the strokes E,F,G and H for utilizing heat trapped on the walls of the chambers. The plane shown on the left column entitled PLANE in FIG. 16 is that contained in the chamber during the entire duration of each stroke. The columns following the first column from left to right, and entitled TIME STROKES represent successive stroke time intervals and are showing the exact stroke being executed by each chamber during each stroke time interval. It should be noted, again, that since the strokes ABCDEFGH are allocated to the planes 0-1 to 0-16 in a forward sense the stroke pattern rotates with time in the reverse direction, shown by the arrow 140. This makes possible the cycle programming and regulation of the intake and exhaust ports by a rotating regulating plate similar to that described in connection with FIG. 5, but now accommodating a complex cycle. I will assume in this instances that the diaphragm configuration shown in FIG. 10 is used in conjunction with a complex cycle whose first four strokes ABCD refer to a Diesel cycle and the additional four strokes EFGH are used for heat utilization as previously described. The intake channel 74*c* is then continuously communicating with the outside air and the exhaust channel 75*c* is connected to an exhaust pipe, not shown. The fuel can be introduced through a solid injection pump system through holes on the cylindrical part of the housing, one at each radial plane 0-1 to 0-16. The position of slots 74*e*, 74*f*, 75*e* and 75*f*, FIG. 11, corresponds to the position of the rotor diaphragms as shown in FIG. 10 with the planes 0-1 and 0-4 assigned to the strokes A and B respectively. The plate 70K of FIG. 11 rotates in the reverse direction shown by the arrow 140 wherein during the first stroke time interval, and in agreement with the table in FIG. 16, the chambers intaking air are the ones containing planes 0-1 and 0-9 and the chambers expelling air are those containing the planes 0-8 and 0-16. The effective intake and exhaust control by the plate 70K during all strokes can be easily verified by comparison of FIG. 11 and the table in FIG. 16. It should be understood that similar considerations as above do apply in the case where the strokes ABCD correspond to an Otto cycle instead of the Diesel cycle; but where the fuel is introduced through special pumps, similar to those used in a Diesel engine, immediately prior to a spark ignition rather than self-ignition. This method of providing fuel to the combustion chamber shows promise since it can help realize effective "stratification" of the fuel concentration in the chamber, permitting initial ignition of the fuel in the vicinity of the spark plug where concentration is made highest and preparation of the burning into the remaining of the chamber where the fuel concentration is made lean. This method achieve power strokes involving on the average lean mixtures with a consequent improvement in efficiency. The invention is particularly adaptable to a "stratified charge" operation because of the additional degree of freedom available in the choice of the shape of the rectangle generating the cavity of revolution 35. Stratification of the fuel concentration can be helped by choosing a greater length of the generating rectangle along the axis than radially. Then the fuel inlet and the sparkplug for each plane can be positioned at one extreme of an elongated chamber near one base so that the fuel can be ignited before it has time to spread along the length towards the other base of the chamber.

Complex cycles may also be considered those which involve complex strokes involving more than one task during each stroke. For example the well known two stroke gasoline engines and two-stroke Diesel engines often associated with small power plants involve complex strokes where for example same stroke may be divided to accommodate both intake of fuel and combustion. Complex strokes can easily be handled by the invention, since it is only a matter of properly timing the cycle in terms of opening and closing the intake and exhaust ports and providing ignition by spark or high temperature at the right time. These controls can be easily provided in the invention through the programming of a rotating plate such as the plate 70. Accurate timing can be provided by adjustment of the length and position of the slots such as 74*a* and 75*a* in FIG. 5.

FURTHER COMPLEX CYCLE USING HEAT FROM UNBURNED GASES, THE CHAMBER WALLS AND THE HOT EXHAUST GASES

Figure 12:
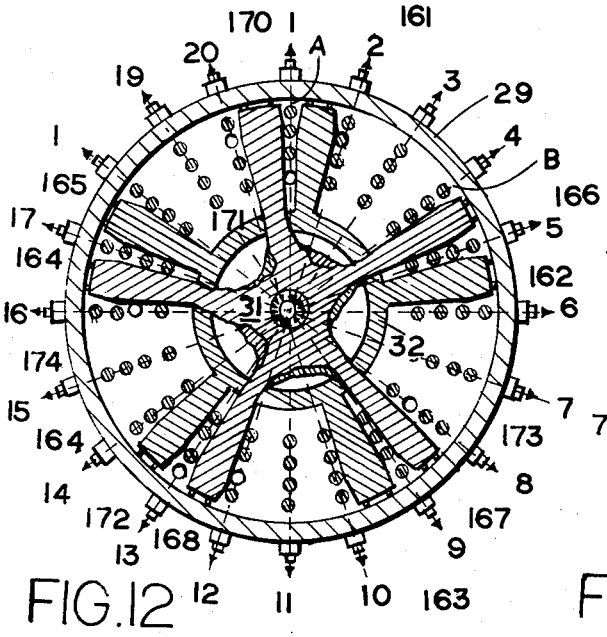
FIG. 12 is a horizontal cross-sectional view of a portion of the engine, presumably taken along line 2—2 of FIG. 1 as in FIGS. 2*a* and 10, but illustrating another example where each rotor has five diaphragms providing the feasability of a 10-stroke-per-cycle engine.
Figure 13:
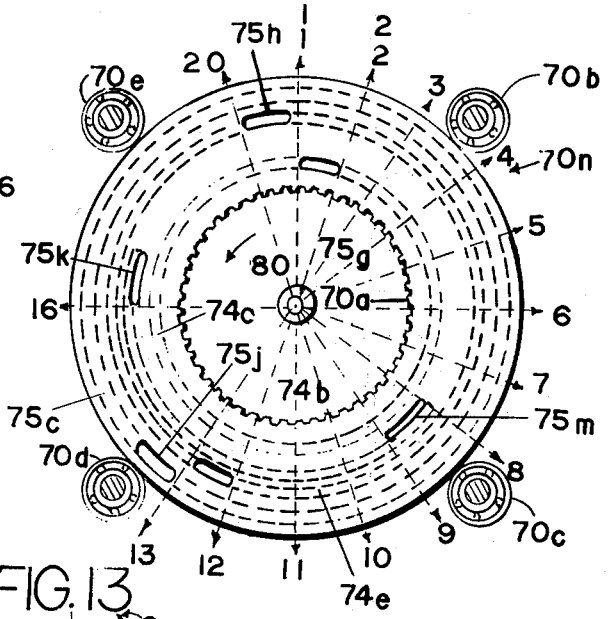
FIG. 13 is a horizontal cross sectional view of a portion of the invention along a line 5—5 of FIG. 1 for illustrating the slot programming of a port control plate used in a ten-stroke cycle aforementioned in connection with FIG. 12.
Figure 15:
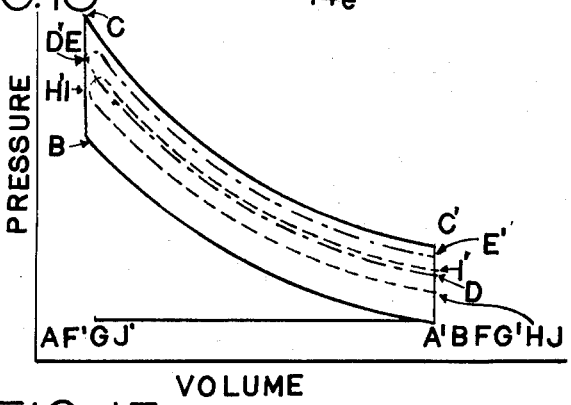
FIG. 15 is a PRESSURE vs VOLUME cycle diagram showing energy, work considerations in the 10-stroke-per-cycle example illustrated in terms of FIGS. 12 and 13.

An example of a further complex cycle is shown in conjunction with FIGS. 12, 13, and 15. FIG. 12 is similar to FIGS. 2*a* and 10, but it illustrates the case where each rotor has five diaphragms so that the engine has a total of ten diaphragms and therefore ten chambers simultaneously cycled. While the ten chambers could be allocated to five two-stroke cycles, in this example I will denomstrate how the ten chambers can be used to perform a single cycle containing strokes A,B,C,-D,E,F,G,H,I, and J. As an example, this cycle will be applied to a gasoline engine. This cycle is to consist of strokes: A for intaking a mixture of carburated air from the carburator, B for compressing the carburated air, C for a first power cycle igniting the carburated mixture and allowing the hot gases to force one of the rotors in forward rotation, D mixing the hot gases with air from a chamber executing stroke H and compressing the mixture for afterburning of unburned hydrocarbons and heat exchange thereby deriving heat from such after burning as well as by extracting heat from the hot chamber walls, and from the hot gases as a result of the first burning, E is the second power stroke allowing the hot gases to expand again while doing additional work, F is the first exhaust, G for intaking cool air, H for mixing the intaken cool air with the hot gases from the chamber executing stroke D and compressing the mixture for afterburning of unburned or semi-burned hydrocarbons and for heat exchange, thereby gradually elevating the temperature of the gas in the chamber from the heat extracted from the hot chamber walls and from the hot gases, being the products of mainly burned hydrocarbons and nitrogen heated during the first power stroke, I for third power stroke allowing the chamber to expand with the hot gases doing additional work, and J for second exhaust. FIG. 17 shows a table indicating the stroke assigned to each chamber during each stroke time interval. Let us assume that the above strokes, A-I, will be assigned to the chambers in FIG. 12 clockwise, whereby the chambers containing the planes 0-1 to 0-20 are simultaneously being assigned the strokes shown in FIG. 17 during the first stroke time interval. The stroke pattern is clearly shown in FIG. 17 to rotate in the reverse direction each subsequent stroke time interval. The amount of this rotation per stroke time interval being approximately equal to 360/2N = 18° in the reverse direction, while the forward displacements of the rotors are approximately 360/N = 36°. The programming of the cycle and exhaust regulation of the time of opening and closing of inlet and exhaust ports is provided mainly by the port regulating plate 75n shown in FIG. 13, the position of which is drawn to correspond to the position of the diaphragms in FIG. 12 at the beginning of the first stroke time interval.

Referring now to FIG. 13, the regulating plate **70*n* is shown having four channels on its lower side: a channel 74*c* extending 360° and continuously being in direct conjunication with a line from a carburator, not shown; a channel 75*c* extending 360° and, continuously being in direct communication with the exhaust pipe, not shown; a channel 74*e* extending 360° and continuously being in direct communication with the outside air; a channel 74*b*** approximately 72° for establishing communication between the two chambers on executing stroke D the other executing stroke H, during the entire stroke time cycle.

Slots extending approximately 18° join the top face of the plate **70*n* with the appropriate channel substantially as shown in FIG. 13: a slot 75*g* for controlling the intake of carburated mixture; two slots 75*h* and 75*j* controlling the expelling of exhaust gases; two slots 75*k* and 75*m*** for mixing the hot gases resulting during the stroke C with cool air intaken during the cycle G for afterburning and heat recovery during the strokes D and H.

FIG. 15 is a diagram showing the VOLUME-PRESSURE relationship in the ten strokes involved in the above complex cycle and also showing the amount of work derived during the cycle. The area enclosed in the line BB'CC'A' is the conventional work extracted by engines working in an Otto Cycle. The complex cycle however provides additional work from afterburning of hydrocarbons and heat recovered from the hot exhaust gases and the walls during the strokes E and I shown as surfaces enclosed inside the curves DD'EE'D' and HH'II'H, respectively, These curves illustrate that the engine can be used towards more complete burning of hydrocarbons and for increasing the thermodynamic efficiency of the engine.

It is to be understood that other improvements and innovations such as variations in the proportions or the methods employed in the carburation of the air or injection of the fuel as previously explained, multiple spark plugs, variations in the length or timing of the strokes or the compression ratio and the use of supplemental devices such as catalytic converters in the exhaust for reducing the amount of pullutants are methods details and accessories concerning a larger class of engines, and with which the present invention can combine to provide improved power plants.

COOLING SYSTEM

The size and type of cooling system needed by the engine provided by the invention, highly depends on the specific type of engine and cycle in which the invention is applied. If the engine for example is to be applied in a hydroelectric power plant converting hydrostatic pressure to useful torque, no cooling system would be required. A minor cooling system provided by an air fan or no cooling system at all may be needed in applications where sufficient heat is extracted from the internal walls of the engine in complex thermodynamic cycles to keep the engine from exceeding a specified safe temperature.

The engine however can be water cooled if such method would be found preferrable or necessary. In FIG. 1 are shown examples of empty spaces 59 and **59*a* to be used either for lightness and insulation or for use in a water or other fluid cooling system. A fluid inlet such as 60, shown in FIG. 1 and a fluid outlet 60*a*, not shown, can be used to connect to an auxiliary fluid pump and water radiator. Because of the cylindrical geometry of the engine a coil having a cross section such as 59*b* and 59*c* can be easily coiled inside the cylindrical spaces 59 and 59*a*** to give the fluid a coil or spiral motion for more effective cooling.

SPARK PLUGS

Spark ignition means such as spark plugs **90*a*, 90*b* . . . 90*h*, shown in FIG. 2*a* can be provided to the engine when the engine is applied in such applications as gasoline engines. One or more spark plugs may be used per chamber. Since chambers may contain any of the planes 0-1 to 0-2N, N as before being the total number of diaphragms in the engine, at least 2N spark plugs will be needed per engine. The spark plugs will preferably be positioned around the cylindrical part of the housing where they can be easily reached for replacement. Whether the spark plug will be positioned half way between the bases of the engine or near one base depends on whether the particular design of the engine will provide a stratified charge or symmetric burning of the fuel. In the azimouth the spark plugs will have to be positioned along each of the imaginary planes 0-1 to 0-2N. Bridging blocks such as 82*a*, shown in FIGS. 1 and 7** and previously discussed in detail in connection with the lubrication of the engine can prevent the spilling of lubricating oil into the recess usually allowed for spark plugs on the internal wall of the housing.

APPLICATIONS

The engine provided by the invention can be used to provide the main engine in various types of power plants. The invention, for example can be applied to convert potential hydraulic pressure into useful torque as is done in hydroelectric power plants. The invention is expected to provide greater efficiency by simpler means than the hydroelectric turbines which are now normally being used in such applications. Note that the engine shown in FIG. 1 can be used as a hydrostatic pressure engine by simply connecting the intake port 76 to the hydrostatic pressure and exhaust port 77 to the sink. In the hydrostatic engine application where it is desirable to process large amounts of fluid, separate port regulating plates for the intake and outlet of the fluid would be preferrable, one such plate next to each base of the engine.

Another application converting some of the fluid pressure into useful torque could be an engine whose torque is used to turn wheels indicating the amount of fluid passing through the engine. The engine then can be used as a water meter or a device for measuring the flow of fluids gaseous or liquid, efficiently and with relatively high accuracy, the operation of the engine being both continuous and quantized.

Figure 20:
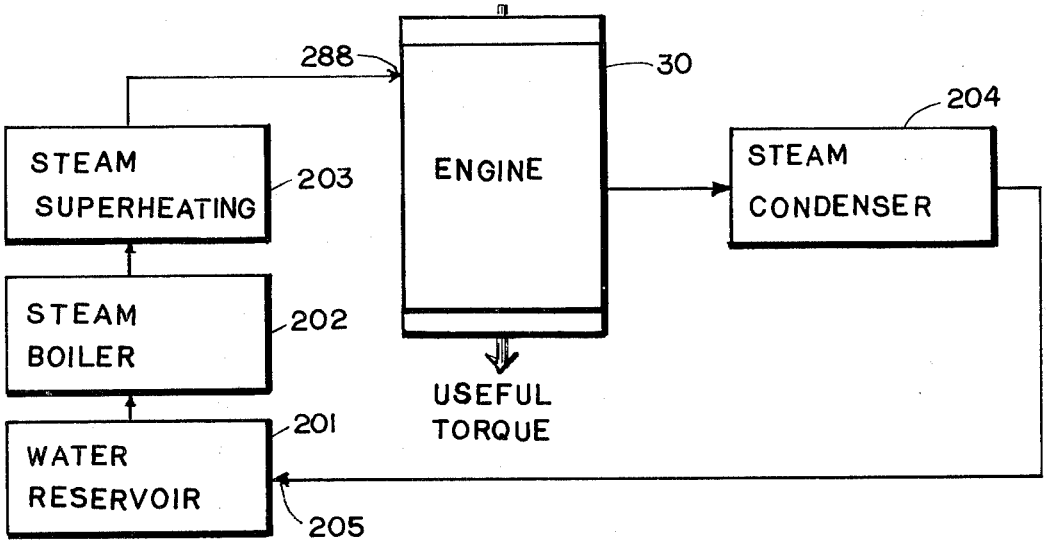
FIG. 20 is a block diagram illustrating the application of the invention in a steam engine power plant.
Figure 24:
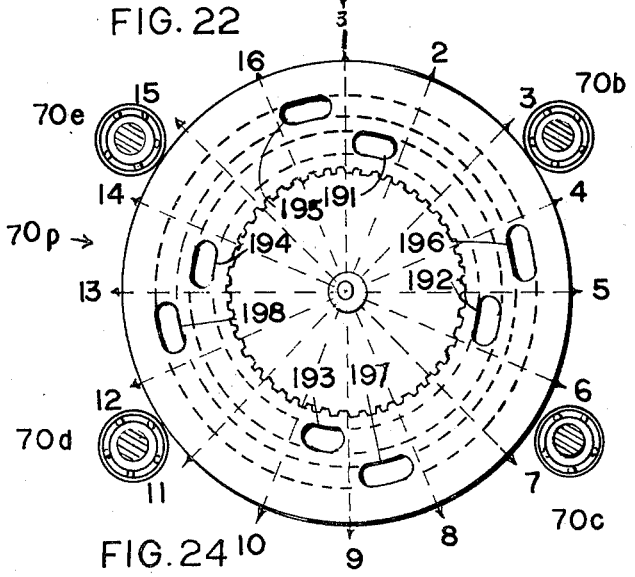
FIG. 24 is a horizontal cross-sectional view of a portion of the invention along a line 5—5 of FIG. 1 for illustrating the slot programming of the port control plate in a steam engine power plant in connection with rotors each having four cavity diaphragms.

Still in the same broad category of engines operated by fluids entering under a higher pressure than the pressure at which they are being expelled is the steam engine and other external combustion engines. FIG. 20 shows a functional block diagram of an external combustion engine using steam as the pressurized fuel, comprising the engine 30 in combination with auxiliary units such as: a water reservoir 201 for containing condensed fluid; feeding into a steam boiler 202 for converting the fluid from a liquid state to a gaseous state; means 203 for superheating the aforesaid gaseous fluid before entering the engine at an inlet such as 76 of FIG. 1, represented in FIG. 20 by an inpointing arrow 288; and steam condensing means converting the expelled gaseous fluid back into the liquid state. It is understood that the FIG. 20 is an example illustrating the application of the engine provided by the invention into external combustion engines and modifications obvious to those skilled in the art are assumed to be implied in FIG. 20. Such obvious modification, for example, would be where the engine is used in connection with steam available at geothermal sources, at moderate pressures. The engine can be used in such an application with great advantages since it can provide a plurality of diaphragms so that the overall force generating torque would be N/2 times the force provided by the steam in one chamber; the invention thus providing an effective amplification to the moderate steam pressure. In geothermal localities where such steam pressure comes inexpensive the engine can be operated in a simple form utilizing the available pressure of a fluid as in the case of the hydrostatic pressure, providing an intake port such as 76 for connecting the pressurized fluid to the engine and an exhaust port such as 77 for expelling the spent fluid after doing work on the diaphragms of the chambers into a sink such as the atmosphere. FIG. 24 shows how the port regulating plate 70*p* would look in the case where the steam engine would provide four diaphragms per rotor as shown in FIG. 10. But now being used as a steam engine, it is simultaneously being operated in four two-stroke cycles, providing four power strokes per stroke time interval using the inlet port slots 191, 192, 193, and 194, FIG. 24, for connecting the pressure providing fluid to the chambers that execute a power stroke and outlet port slots 195, 196, 197, and 198 for connecting the chambers executing an exhaust stroke with either a steam condenser or the outside atmosphere.

Figure 21:
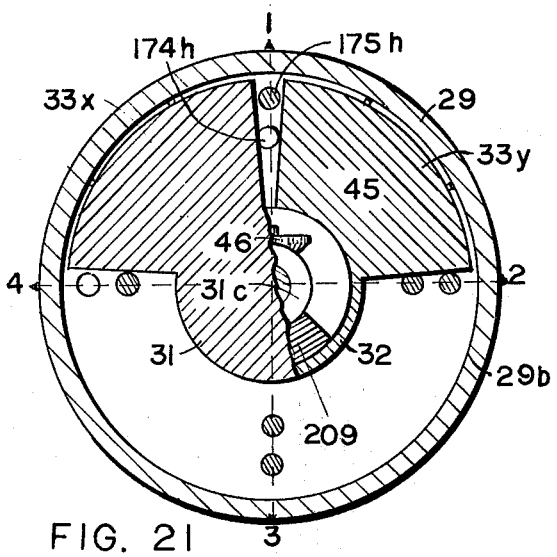
FIG. 21 is a horizontal cross-sectional view of a portion of the engine taken along line 2—2 of FIG. 1, illustrating an engine with only one cavity diaphragm on each rotor; with portion of the top rotor broken away for the purpose of revealing portions of the other rotor and of the differential gear assembly.
Figure 22:
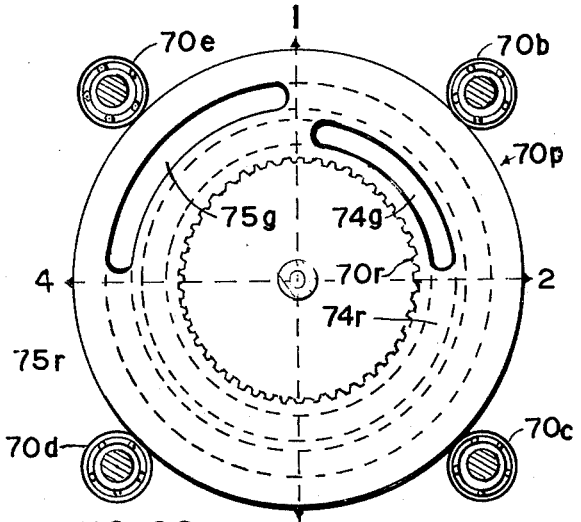
FIG. 22 is a horizontal cross-sectional view of a portion of the invention along a line 5—5 of FIG. 1 for illustrating the slot programming of the port control plate used in a steam engine power plant in connection with rotors each having a single cavity diaphragm.

In applications where high fluid pressure is available a single diaphragm per rotor may suffice with the engine thus providing two chambers operating at a time and four planes 0-1 to 0-4. The diaphragm displacement per stroke will be approximately 360/N = 180°. FIG. 21 illustrates an engine having one diaphragm 33x attached to rotor 31 and one diaphragm 33y attached to the rotor 32. Four planes are shown 0-1 to 0-4, each having a pair of port holes one input port hole such as 174*h* and one output port hole such as 175*h*. Counterweights such as a counterweight 209 will be needed to counterbalance the moment of inertia for eliminating vibration of the rotors. FIG. 22 shows how the port regulating plate would look when both the inlet and outlet ports are positioned on the same base of the engine. The rotational position of the plate 70*p* is drawn to correspond to the position of the rotors shown in FIG. 21. In FIG. 22 the plate 70*p* has two channels 74*r* and 75*r* at the lower face and two through slots 74*g* and 75*g* corresponding to an inlet port such as 76 and an outlet port such as 77 of FIG. 1, respectively.

In reverse the configuration of FIG. 1 can be used as a compression or vacuum pump converting input torque into change of pressure in a vessel.

Figure 23:
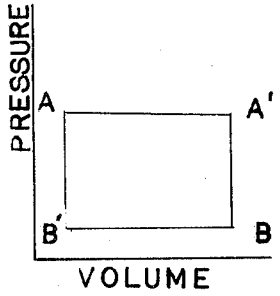
FIG. 23 is a PRESSURE vs VOLUME cycle diagram illustrating the pressure volume relationship when the invention is applied to a two-stroke steam cycle.

FIG. 23 shows the work done during a pressure two-stroke A, B cycle, where A stands for intake and power stroke in an expanding chamber under the influence of pressure entering through an inlet port and B stands for expelling the fluid contributing the aforesaid pressure, subsequent to the expansion, in a contracting chamber. The stroke A is represented by the line AA′ during which the chamber expands at a relatively constant pressure, the chamber being in communication with the source of the fluid contributing the pressure. At the end of the stroke, the outlet port opens and the pressure in the chamber drops to a low pressure, wherein the stroke B is executed as is represented by the line BB′ in FIG. 23.

Figure 18:
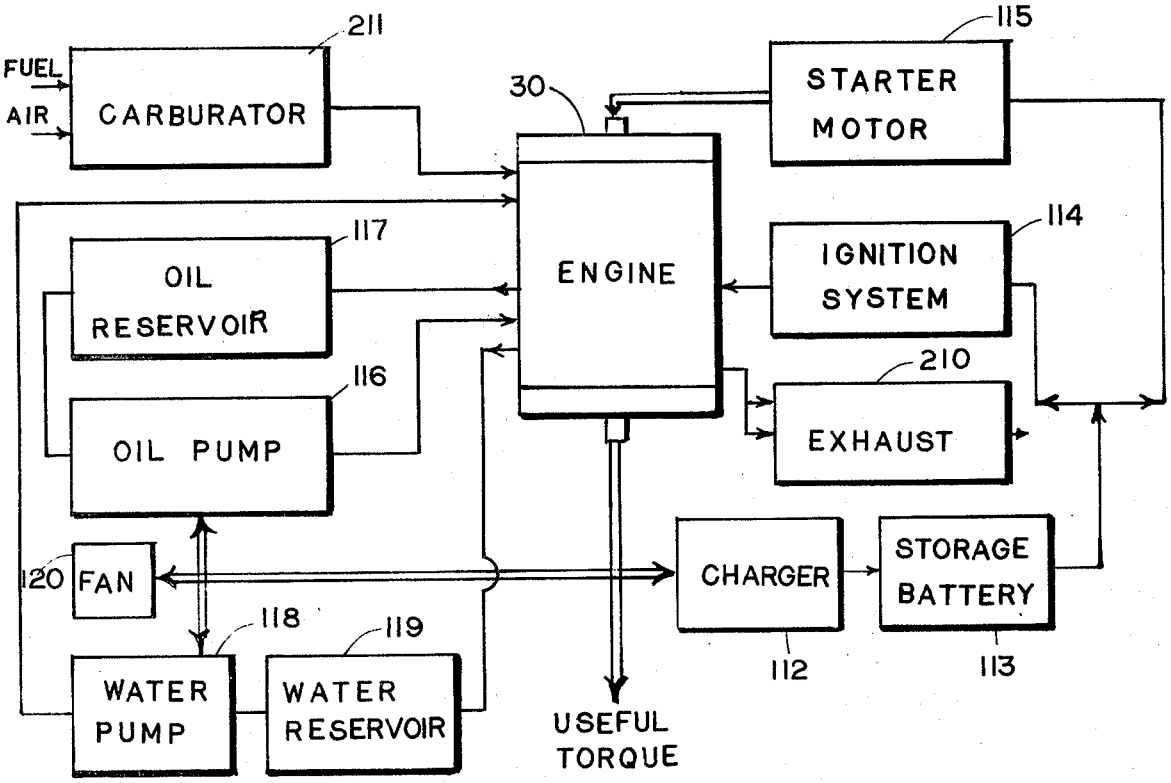
FIG. 18 is a block diagram illustrating the application of the invention in a gasoline engine power plant.
Figure 19:
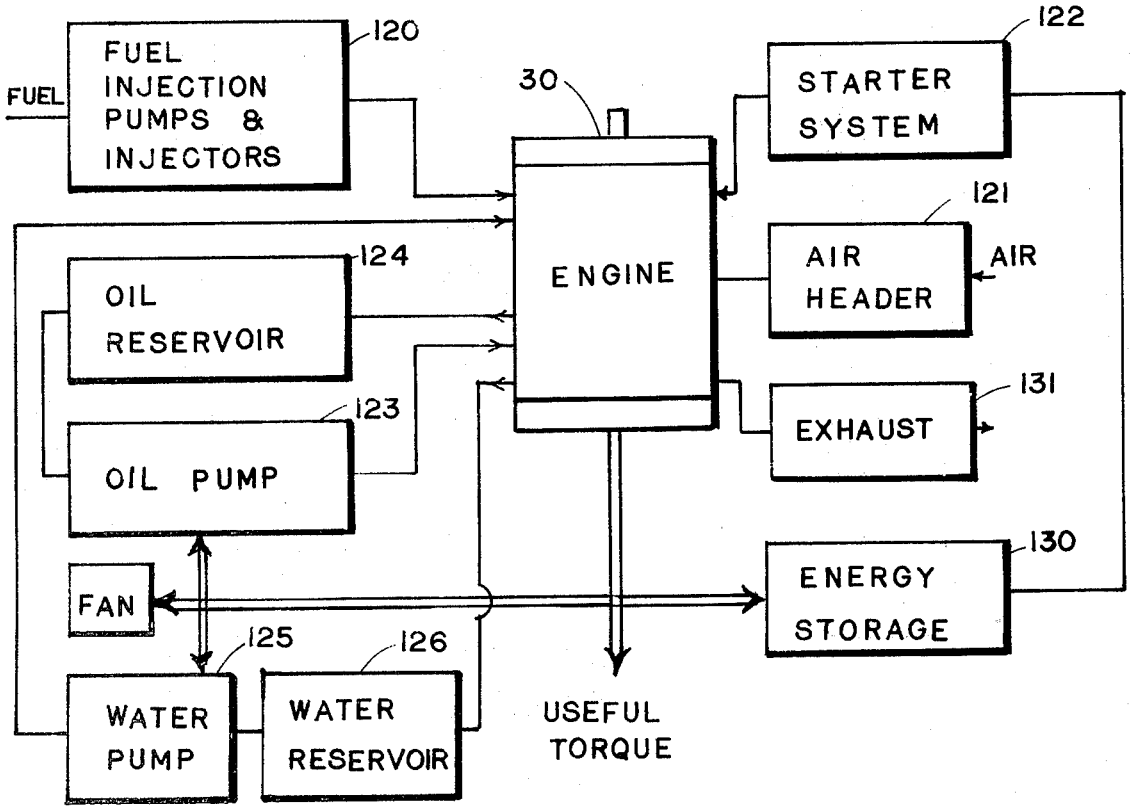
FIG. 19 is a block diagram illustrating the application of the invention in a diesel power plant.

FIGS. 18 and 19 illustrate examples where the engine provided by the invention is used as an internal combustion engine. FIG. 18 is a functional block diagram illustrating the case where the engine is used as a gasoline engine power plant comprising in combination an engine 30 substantially as described in various forms above, in combination with auxiliaries and accessories such as carburator means 211 for preparing a mixture of air and hydrocarbons for the engine 30; ignition means normally including battery charging means 112 for maintaining a storage battery means 113 in charge condition, and ignition system means 114 including such known components as ignition coil, distributor points and spark plugs for providing igniting sparks to the carburated mixture during the power cycle; starter motor means 115 for starting the engine; lubricating means including oil pump means 116 and oil reservoir means 117 for lubricating moving parts in the engine 70; fluid cooling means including water pump means 118 and water reservoir means 119, a good part of which is normally being used as radiator for cooling the fluid while receiving an air draft from fan means 120;

and exhaust means for damping the exhaust gases to the atmosphere. Such exhaust means may include special processing means such as catalytic converters, for reducing the amount of pullutants that will go to the atmosphere. FIG. 18 also illustrates the flow of energy, showing fuel and air entering the carburator 211 to be converted into torque, heat and exhaust gases. The output torque is shown to be split as useful torque, as torque used to store electrical energy into the storage battery 113 and torque for driving auxiliaries such as the water pump means 118, the fan means 120, and the oil pumping means 116. Some of energy is lost as heat in the cooling system and the exhaust.

It is to be understood that the term "gasoline engine" used in this specification refers to an engine being operated in an Otto cycle or modified Otto cycle usually using gasoline for fuel; gasoline engines, however, may be adjusted to use other fuels such as propane gas or "admixtures" of fuel such as gasoline with hydrogen for the purpose of igniting lean mixtures through spark plugs, for an increase in efficiency. Similarly a "water cooling" system may use other fluids such as the normally used antifreeze, or alcohol.

FIG. 19 illustrates an example where the engine provided by the invention is being applied in combination with associated auxiliary components as a diesel engine power plant, comprising an engine 30 substantially as described in various forms above, in combination with fuel injection pumps and injector means 120 for "air injection" or solid injection of fuel into the chambers at a predetermined cycle phase for starting a power cycle; air header means 121 for providing air at predetermined pressure to the engine 30; starter system means 122 including either electrical starter motor or an air pressure arrangement; energy storage means 130 for storing energy for driving the said starter system means, this energy being in the form of electrical storage or air pressure storage depending on the way the said starter system means operates; lubricating means including oil pump means 123 and oil reservoir 124; cooling system means including water reservoir means 126 for containing the fluid used for cooling, water pump means 125 for pumping the cooling fluid and fan means for cooling the cooling fluid while in said water reservoir means 126; and exhaust means 131 for expelling the burned products of the fuel and air mixture into the atmosphere. The means 131 may include special processing means such as catalytic converters for reducing the amount of pollutants going to the atmosphere. The FIG. 19 also illustrates the energy flow in the Diesel engine power plant to be substantially similar to that shown in FIG. 18 in connection with the gasoline engine power plant.

It is to be understood that the power plant shown in FIG. 19 may be modified to be operated in a "stratified charge" Otto cycle where in addition to special injector means 120 for air or solid injection of the fuel, spark plugs are used to ignite the fuel in the combustion chambers as previously explained in this description.

EMBODIMENTS AND SPECIES OF THE INVENTION

In the above discussion I have described mainly five embodiments as follows:

First Embodiment

A two-stroke cycle power plant for converting a pressure provided externally to the engine into torque. This embodiment covers exmaples such as:

a. a power plant using hydrostatic pressure as would the engines used in hydroelectric power plants;
b. a power plant using pressure in the form of steam from sources such as geothermal steam sources;
c. a power plant using pressure in a liquid for measuring the amount of such liquid passing through the engine;
d. a steam engine power plant working in conjunction with such other auxilary components as a heat source, a boiler, steam superheater and steam condenser.

Second Embodiment

A gasoline power plant for converting fuel such as gasoline, propane gas, or admixtures such as gasoline with hydrogen into torque and using spark plugs for ignition of the fuel mixture or admixture. This embodiment covers examples such as:

a. a gasoline power plant operating in a two-stroke cycle
b. a gasoline power plant operating in the classical four-stroke Otto cycle
c. a gasoline power plant operating in a novel eight-stroke cycle.
d. a gasoline power plant operating in a novel 10-stroke cycle.
e. a gasoline power plant operated in novel cycles made up of other combinations of the strokes involved in the above cycles.
f. a gasoline power plant operated in a stratified charge method of injecting and distributing the fuel in the combustion chambers and in any of the above cycles.

Third Embodiment

A Diesel power plant for converting fuel such as diesel fuel or jet fuel into torque, and using high pressure and relatively high compression ratios in igniting the fuel in the combustion chambers. This embodiment covers examples such as:

a. a Diesel power plant operating in the classical two-stroke Diesel cycle.
b. a Diesel power plant operating in the classical four-stroke Diesel cycle.
c. a Diesel power plant operating in a novel eight-stroke cycle
d. a Diesel power plant operating in a novel 10-stroke cycle.
e. a Diesel power plant operating in a novel cycle made up of other combinations of the strokes involved in the above cycles.

Fourth Embodiment

An accurate fluid measuring device, such as a water meter.

Fifth Embodiment

A pump converting input torque to change of pressure of a fluid in a container. A self operated pressure or vacuum valve, not shown, can be added to the port 27 or 26, respectively. Examples:

a. A compressor pump.
b. A vacuum pump.

I claim:

1. A rotary engine converting energy into work comprising:

a stationary housing including internally a first surface of revolution disposed about an imaginary line to be referred to as the axis;

a first rotor including a second surface of revolution about the axis;

a second rotor including a third surface of revolution about the axis;

a cavity of revolution about the axis, being formed by the aforesaid three surfaces of revolution;

a first set of cavity diaphragms rigidly attached to said first rotor, and extending across and dividing said cavity of revolution into a number of substantially equal volume subcavities;

a second set of cavity diaphragms rigidly attached to said second rotor and extending across, said cavity of revolution, said second set of diaphragms being interleaved with said first set of diaphragms whereby each of the aforesaid subcavities is further divided into two chambers, each chamber thus being bounded by a portion of each of the aforesaid three surfaces of revolution and two cavity diaphragms, one belonging to each of said rotors with the circular geometry providing a continuous sequence of such chambers circumferentially disposed around the axis, wherein the volume of a chamber is increased while the volume of the adjacent chamber is being equally decreased when said first and said second set of diaphragms are forced to rotate with respect to each other, such increasing and decreasing of the volume of the chambers representing the execution of a plurality of predetermined strokes, the sequence of such strokes representing a preprogrammed cycle;

intake and exhaust ports on said housing, for intaking an energy containing fluid and for exhausting such fluid after some of the energy has been converted to torque;

stroke programming means comprising a plate rotating in sliding contact with one of the bases of said housing, their relative rotation establishing and interrupting coincidence of slots with holes, positioned at predetermined radial and azimouthal positions on the rotating plate and the adjacent base of said housing, for establishing communiction passages between the aforesaid chambers and said intake and exhaust ports on said housing, for preprogramming the strokes to be performed by each of the aforesaid chambers;

said stroke programming means also being operative in establishing the timing of intaking energy cyclically into the chambers while in a predetermined phase of a predetermined stroke wherein such energy is alternately being used for exerting pressure onto the diaphragms of such chambers for alternately forcing said first set of diaphragms and therefore its associated said first rotor in a forward direction and said second set of diaphragms and therefore its associated said second rotor in the reverse direction, causing the volume of such chambers to expand; said stroke programming means also being operative in establishing the timing for exhausting the remains of the intaken fluid; means for limiting the rotation of said second rotor whereby the work done by the energy is converted in a predetermined forward rotational displacement of said first rotor; and wherein alternately, the intaken energy is also being used for exerting pressure causing said first set of diaphragms and therefore its associated said first rotor to be forced in the reverse rotational direction, and said second set of diaphragms and therefore its associated said second rotor to be forced in the forward rotational direction;

means for limiting the rotation of said first rotor whereby the work done by the energy is converted into a predetermined forward rotational displacement of said second rotor, thereby in accordance with said stroke preprogramming means said first and said second rotors are alternately forced to rotate through predetermined forward displacements;

and means for transfering torque from said first and/or said second rotor to at least one output shaft.

2. The engine of claim 1 wherein said cavity of revolution has a substantially rectangular cross section, further comprising forward motion limiting means for limiting the motion of each set of diaphragms in the forward rotational direction at predetermined azimouthal angles during predetermined time intervals of the thermodynamic cycle, said limiting means, operative during starting of the engine and in the case of misfirings.

3. The engine of claim 1 wherein the means for limiting the rotation of a rotor includes a wire with one of its ends fastened onto said housing and with its length wrapped around a cylindrical portion of the rotor in the sense in which reverse rotation of the rotor will be prevented by the wire tightening around the rotor, but forward rotation of the rotor will be permitted by the wire tending to unwind around the rotor.

4. The engine of claim 2 wherein there is at least one pair of rows of sealing elements installed on each diaphragm and wherein there are spring loaded blocks filling the space between such a pair of rows of sealing elements for covering openings such as intake and exhaust ports and spark plug recesses while the row of sealing elements wipes over such openings and recesses as the diaphragm revolves about the axis.

5. The engine of claim 4 wherein the channel formed by the pair of rows of the sealing elements, by the surfaces of diaphragms and the cavity of revolution which is included between the pair of rows of sealing elements is used for transmission of lubricant, and wherein the blocks used for covering the openings and recesses provide on the side opposite to the surface of the cavity of revolution a channel for the continuation of transmission of the lubricant.

6. The engine of claim 2 wherein the means for implementing the various processes in each stroke and the means for opening and closing of the intake and exhaust ports include a plurality of continuous channels on at least one face of the rotating plate means; slots of predetermined azimuthal length and at predetermined azimuthal positions cut along the aforesaid channels, inlet and outlet ports provided on at least one outer base of said housing at radial distances substantially equal to that of corresponding channels and holes cut through at least one inner base of said housing at corresponding radial distances with the channels and at predetermined 2N imaginary radial planes, N being the total number of diaphragms in the engine.

7. The engine of claim 2 further comprising:

in connection with each of said rotors at least one post carried around the axis and extending from the rotor towards the nearest base of said housing;

means for holding said post substantially parallel to the axis and radially adjustable with respect to the axis;

a rotating guiding plate attached to said center shaft between the rotor carrying said post and the nearest outer base of said housing, said guiding plate including at least one slot azimuthally and radially extending along predetermined distances over said guiding plate for engaging said post as the post is extending through the slot, whereby the radial position of said post becomes a function of the relative position of said center shaft and of said guiding plate, such relative position determining the travel of said post in the slot provided by the guiding plate;

a circumferential plate attached and preferably spring loaded with respect to the base of said housing which is on same end of the housing as the rotor, including inwardly directed protrusions for engaging with said post thereby limiting further rotation of the rotor when the post is positioned by the slot outwardly from the axis, but not interfering with the post when the post is positioned inwardly away from the protrusions;

whereby as torque is applied forcing both rotors in the forward direction the rotors are guided to alternately one and then the other rotor rotating in the forward direction at predetermined rotational displacements.

8. The engine of claim 1 further comprising cooling means.

9. The engine of claim 2 wherein said stroke programming means are preprogrammed to execute a 10-stroke cycle and wherein predetermined strokes are used for converting heat derived from unburned hydrocarbons, from the wall of the chambers, and from the hot exhaust gases into torque.

10. The engine of claim 2 further comprising water and or air cooling means;

sealing element means for effectively separating volumes of adjacent chambers;

lubricating means for lubricating surfaces in relative motion for reduction of friction losses;

means of gearing up the rotational speed of an output shaft with respect to a center shaft by a predetermined ratio;

wherein each rotor includes n substantially similar diaphragms disposed at angles substantially equal to $360/n°$ around the rotor, each diaphragm having an azimouthal thickness a predetermined angle (e) less than an angle $90/n°$ and the average displacement of each rotor being substantially equal to an angle $180/n°$, operated in a multi-stroke internal combustion cycle, whereby a fuel containing hydrocarbons is converted to torque.

11. The engine of claim 10 in combination with gasoline power plant auxiliaries whereby the engine is operated as a gasoline engine power plant for converting gasoline and the like into torque.

12. The engine of claim 10 in combination with Diesel engine power plant auxiliaries whereby the engine is operated as a Diesel engine power plant for converting kerosene and the like into torque.

13. The engine of claim 10 further comprising injection system means for affecting a stratified charge operated gasoline engine power plant.

* * * * *